US009412511B2

(12) United States Patent
Shimode et al.

(10) Patent No.: US 9,412,511 B2
(45) Date of Patent: Aug. 9, 2016

(54) TRANSFORMER

(75) Inventors: Daisuke Shimode, Aichi (JP); Toshiaki Murai, Aichi (JP); Tadashi Sawada, Aichi (JP)

(73) Assignee: Central Japan Railway Company, Aichi (JP)

( * ) Notice: Subject to any disclaimer, the term of this patent is extended or adjusted under 35 U.S.C. 154(b) by 191 days.

(21) Appl. No.: 13/332,681

(22) Filed: Dec. 21, 2011

(65) Prior Publication Data

US 2012/0154098 A1 Jun. 21, 2012

(30) Foreign Application Priority Data

Dec. 21, 2010 (JP) ..... 2010-284803

(51) Int. Cl.

| | |
|---|---|
| ***H01F 27/02*** | (2006.01) |
| ***H01F 21/04*** | (2006.01) |
| ***H01F 21/06*** | (2006.01) |
| ***H01F 17/06*** | (2006.01) |
| ***H01F 27/30*** | (2006.01) |
| ***H01F 27/28*** | (2006.01) |
| ***H01F 30/06*** | (2006.01) |

(52) U.S. Cl.

CPC ..... *H01F 30/06* (2013.01)

(58) Field of Classification Search

USPC ..... 336/82, 83, 90, 115, 120, 121, 178, 336/198, 220, 229

See application file for complete search history.

(56) References Cited

U.S. PATENT DOCUMENTS

| | | | | |
|---|---|---|---|---|
| 2004/0119576 | A1 * | 6/2004 | Nakao et al. | 336/225 |
| 2008/0129246 | A1 * | 6/2008 | Morita et al. | 320/108 |
| 2010/0102915 | A1 * | 4/2010 | Rhodes et al. | 336/220 |

FOREIGN PATENT DOCUMENTS

| | | | |
|---|---|---|---|
| JP | S6310507 | A | 1/1988 |
| JP | H0878257 | A | 3/1996 |
| JP | 08126108 | A * | 5/1996 |
| JP | H11195545 | A | 7/1999 |
| JP | 2007142081 | A | 6/2007 |
| JP | 2008087733 | | 4/2008 |
| JP | 2008120239 | | 5/2008 |

(Continued)

OTHER PUBLICATIONS

Office Action from corresponding Japanese Patent Application No. 2010-284803, mailed Jun. 24, 2014 with English translation (4 pages).

(Continued)

*Primary Examiner* — Tsz Chan

(74) *Attorney, Agent, or Firm* — Mai-Tram D. Lauer; Westman, Champlin & Koehler P.A.

(57) ABSTRACT

A transformer includes a primary coil, a secondary coil, and a core. The core is to be used in combination with the primary coil or the secondary coil, and includes a conductor storage part and a central part. The conductor storage part is a concave recess formed in an annular manner and configured to store a conductor of the coil therein. The central part is a region inward from the conductor when the core is used in combination with the coil. The central part has a recessed shape having an opening that opens toward a direction opposite to a direction of an opening of the concave recess. The central part has an end, at a side opposite to a side of the opening of the central part, which is generally flat so as to be contiguous with an inner opening edge of the conductor storage part.

20 Claims, 25 Drawing Sheets

(56) References Cited

FOREIGN PATENT DOCUMENTS

| | | | | |
|---|---|---|---|---|
| JP | 2009054927 | A | | 3/2009 |
| JP | 2009123943 | A | * | 6/2009 |
| JP | 2009170627 | A | * | 7/2009 |
| JP | 2010041906 | A | | 2/2010 |
| WO | 2007080820 | A1 | | 7/2007 |
| WO | 2010098547 | A2 | | 9/2010 |

OTHER PUBLICATIONS

Japanese Notice of Reasons for Rejection from corresponding Japanese Patent Application No. 2010-284803, issued Mar. 10, 2015 with English translation (4 pages).

* cited by examiner

TRANSFORMER

CROSS-REFERENCE TO RELATED APPLICATIONS

This application claims the benefit of Japanese Patent Application No. 2010-284803 filed Dec. 21, 2010 in the Japan Patent Office, the disclosure of which is incorporated herein by reference.

BACKGROUND

The present invention relates to a transformer, specifically a transformer having a gap between a primary coil and a secondary coil.

As shown in FIG. 24, as a transformer having a gap between a primary coil 10 and a secondary coil 20, a following configuration is known: an E-type core 30*e* (an iron core or a magnetic core) having an E-shaped cross section is wound with, for example, the secondary coil 20, and the E-type core 30*e* with the secondary coil 20 being wound therearound is arranged to face the primary coil 10. In this connection, however, following problems exist: it is difficult to manufacture the integrally-formed E-type core 30*e*; and even if such manufacturing can be achieved, manufacturing costs thereof are costly.

In order to solve the above problems, it has been suggested to form an E-type core by stacking plate-like cores on one another, thereby facilitating the manufacturing of the E-type core and reducing the manufacturing costs (see, for example, Unexamined Japanese Patent Application Publication No. 2008-120239; hereinafter, referred to as "Patent Document 1").

Patent Document 1 also suggests, as an embodiment of an E-type core capable of handling a small amount of an electric power compared with the integrally-formed E-type core, a transformer having a configuration in which parts of the core are removed in a striped manner. This configuration can provide an advantage of reducing materials to be used for the core, thereby reducing a weight of the transformer.

Moreover, since there is a problem in which the E-type core is heavy, it is suggested to use a flat-plate like core for the purpose of reducing a weight of a transformer (see, for example, Unexamined Japanese Patent Application Publication No. 2008-087733; hereinafter, referred to as "Patent Document 2"). As shown in FIG. 25, the flat-plate like core 30*p* is arranged adjacent to a secondary coil 20 such that the secondary coil 20 is located between the flat-plate like core 30*p* and a primary coil 10. Alternatively, the flat-plate like core 30*p* is arranged adjacent to the primary coil 10 such that the primary coil 10 is located between the flat-plate like core 30*p* and the secondary coil 20 (this arrangement is not shown).

SUMMARY

In the E-type core such as described in Patent Document 1, a magnetic saturation phenomenon is less likely to occur due to a large volume of the core. In this case, there is an advantage in which a performance of the transformer having the E-type core can be improved, compared with a transformer having a core in which a magnetic saturation phenomenon may occur due to a small volume thereof. The E-type core, however, involves a following problem: since the E-type core has the large volume, the weight of the core is heavy; accordingly, a weight of the transformer is also heavy.

Moreover, as described in Patent Document 1, when the E-type core is formed by stacking the plate-like cores, an air gap is likely to be formed between contact faces of the respective plate-like cores. Since this air gap becomes a magnetic resistance, the performance of the transformer may be degraded.

Furthermore, as described in Patent Document 1, when the configuration in which the parts of the core are removed in the striped manner is adopted, a following problem arises: efficiency of the transformer decreases depending on a removal ratio of the core, compared with a core in which parts thereof are not removed. When an electric power to be used (transmitted) is limited depending on the removal ratio of the core, a problem of decrease in the efficiency of the transformer will not occur. However, when the electric power to be used is not limited, a problem occurs in which the efficiency of the transformer decreases because of a greater loss of the electric power in the transformer.

Meanwhile, use of the flat-plate like core such as described in Patent Document 2 can provide an advantage in which a volume of the core is small, thereby making it possible to reduce a weight of the core, compared with the E-type core. In this case, however, a following problem exists: an electromagnetic gap becomes greater, compared with when using the E-type core, and thus, efficiency of the transformer may be decreased. Here, the electromagnetic gap is a gap between the primary coil and the flat-plate like core arranged facing to each other.

In one aspect of the present invention, it is preferable to provide a transformer with improved performance, and a reduction of weight and manufacturing costs.

The transformer of the present invention includes a primary coil and a secondary coil, and a core. The core is to be used in combination with the primary coil or the secondary coil. Each of the primary coil and the secondary coil may be formed by winding a conductor formed into an elongated shape, for example, a linear shape. The core includes a conductor storage part and a central part. In the conductor storage part, a conductive wire portion of the primary coil or the secondary coil is to be arranged. The conductor storage part is a concave recess formed in an annular manner. In other words, the conductor storage part is capable of storing the conductive wire portion of the primary coil or the secondary coil therein. The central part is located in a region inward from the conductive wire portion of the primary coil or the secondary coil (a region inward from the conductor storage part).

The central part has a recessed shape having an opening that opens toward a direction opposite to a direction of an opening of the concave recess of the conductor storage part. The central part has an end, at a side opposite to a side of the opening of the central part, which is generally flat so as to be contiguous with an inner opening edge of opening edges of the conductor storage part.

By adopting the above configuration, the core of the transformer in the present invention can reduce the electromagnetic gap compared with the flat-plate like core such as described in Patent Document 2. The electromagnetic gap is a distance between the core (specifically, the central part) and one coil of the primary coil and the secondary coil, which is positioned opposing to the other coil to which the core is provided. Moreover, the core in the present invention is formed of the conductor storage part and the central part; therefore, parts which do not contribute to a flux path are reduced. By the above configuration, it is possible to reduce a volume of the core, compared with the E-type core such as described in Patent Document 1. Moreover, it is preferable that the core in the present invention has a thickness in which magnetic saturation of the core does not occur and distribution of a magnetic flux inside the core is uniform.

Further, the core may include a flange portion. The flange portion extends outward from an outer opening edge of the opening edges of the conductor storage part. By adopting this configuration, the core in the present invention can effectively collect a magnetic flux extending between the primary coil and the secondary coil, compared with a core without the flange portion. Consequently, an improved performance of the transformer in the present invention can be achieved.

The conductor storage part may have a thickness larger than a thickness of the central part. By constituted as above, the core in the present invention can inhibit magnetic saturation from occurring in the conductor storage part arranged at a position close to the conductor (coil) where an electric current flows. Meanwhile, in the central part, magnetic saturation is less likely to occur. Accordingly, by making the thickness of the central part be thinner than the thickness of the conductor storage part, weight reduction of the core in the present invention can be achieved.

The central part may include an aperture which penetrates through a member constituting the central part. The aperture may be a through-hole. The through-hole may be a slit-like hole. As a result of having the aperture in the central part, the weight of the core in the present invention can be reduced. Moreover, the central part has a low efficiency in collecting the magnetic flux existing between the primary coil and the secondary coil, compared with the conductor storage part. Therefore, even if the aperture is formed in the central part, influence due to decrease of an inductive voltage in the core of the present invention can be minimized.

The core according to the present invention may be formed of a plurality of plate members stacked upon one another. Each of the plurality of plate members may include one or more slits. The plurality of plate members may be stacked such that the one or more slits of any given one of the plurality of plate member does not overlap with the one or more slits of each of the plurality of plate members that is adjacent to the given one of the plurality of plate members. By adopting this configuration, if the core is expanded or contracted due to temperature change around the core and therefore, temperature change in the core, such an expansion or contraction can be absorbed by spaces in the slits. For this reason, it is possible to alleviate compression stress and tensile stress acting on the plate members constituting the core. Thereby, occurrence of breakage or the like of the core can be suppressed.

Each of the primary coil and the secondary coil may have at least two sides substantially parallel to each other. The primary coil may be formed to have a length longer than a length of the secondary coil in an extending direction of the two sides. In this case, the core arranged at a side of the secondary coil may include a plurality of core segments each extending in a direction substantially horizontally perpendicular to the two sides. The core segments may be arranged to be spaced apart from one another in the extending direction of the two sides.

By constituted as above, the core can be formed of a plurality of relatively small core segments. Thus, compared with forming the integrally-formed core, it is possible to use a material (plate member) which is relatively small as a material to be used for manufacturing the core. Moreover, compared with obtaining a larger plate member, obtaining the aforementioned small plate member is easy and less expensive. Thus, manufacturing costs of the transformer in the present invention can be reduced.

Moreover, it is preferable that, compared with the plate member constituting the integrally-formed core, each of the plate members each constituting the core segments has a thick plate thickness, depending on a distance at which the core segments are arranged apart from one another (hereinafter, "arrangement distance"). That is to say, it is preferable that even if the core is formed of the core segments arranged at the distance apart from one another, the core is configured to have substantially the same volume as a volume of the integrally-formed core. For example, when a ratio of a width of the core segment to a length of the arrangement distance in the aforementioned extending direction of the two sides is 1:1, the core segment may preferably have the plate thickness as twice as the plate thickness of the integrally-formed core. By constituted as above, even if the core is formed of the core segments spaced apart from one another, it is possible to inhibit the performance of the core from decreasing.

The conductor storage part of the core, which is to be used in combination with the secondary coil, may have a size such that only a predetermined portion of the secondary coil is arranged in the conductor storage part.

More specifically, each of the primary coil and the secondary coil may have at least two sides substantially parallel to each other. The primary coil may be formed to have a length longer than a length of the secondary coil in the extending direction of the two sides. In this case, the conductor storage part may be formed to have a length shorter than the length of the secondary coil in the extending direction of the two sides. A part of the secondary coil may be exposed from the conductor storage part in areas at both ends of the conductor storage part in the extending direction of the two sides. In other words, the conductor storage part may be formed to have a shape such that an outer portion thereof is removed while at least a portion on a side of the central part is not removed.

By the above constitution, the weight reduction of the core can be achieved. Moreover, the above-mentioned outer portion of the conductor storage part, which is located outward from the secondary coil, has a low efficiency in collecting the magnetic flux existing between the primary coil and the secondary coil, compared with other portions. Therefore, even if the conductor storage part is formed by removing the above-mentioned outer portion thereof, influence due to decrease of an inductive voltage in the secondary coil can be minimized.

Here, the core may be arranged to both at a side of the primary coil and the side of the secondary coil.

According to the transformer of the present invention, it is possible to shorten the electromagnetic gap, compared with the flat plate-like core such as described in Patent Document 2. Furthermore, since the core according to the present invention is formed of the conductor storage part and the central part, the parts which do not contribute to the flux path are reduced. Because of this, it is possible to reduce the volume of the core, compared with the E-type core such as described in Patent Document 1. Consequently, following advantageous effects can be obtained: the performance of the transformer in the present invention can be improved; and the weight as well as the manufacturing costs of the transformer in the present invention can be reduced.

BRIEF DESCRIPTION OF THE DRAWINGS

The invention will now be described below, by way of example, with reference to the accompanying drawings, in which.

DETAILED DESCRIPTION OF THE PREFERRED EMBODIMENTS

First Embodiment

Figure 1:
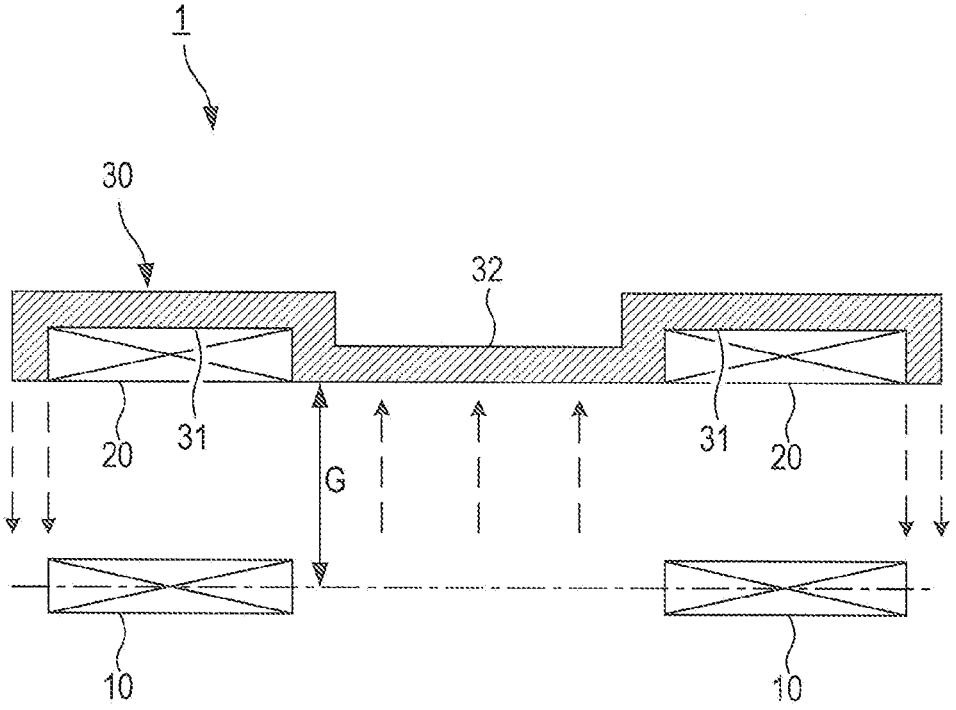
FIG. 1 is a cross-sectional view showing a configuration of a transformer according to a first embodiment of the present invention.

Hereinafter, a transformer 1 according to a first embodiment of the present invention will be described with reference to FIGS. 1 to 4.

The transformer 1 according to the first embodiment shown in FIGS. 1 to 4 is mainly composed of a primary coil 10, a secondary coil 20, and a core 30. An alternating current is to be supplied from outside to the primary coil 10. In the secondary coil 20, an inductive voltage is induced by a magnetic flux generated as a result of an electric current flowing into the primary coil 10. The core 30 is provided in a vicinity of the secondary coil 20.

In the transformer 1, a voltage which is different from a voltage applied to the primary coil 10 is induced in the secondary coil 20. The first embodiment will be explained with regard to an example in which the core 30 is provided only to the secondary coil 20; however, the core may be also provided to the primary coil 10 and thus, the present invention should not be limited to this example.

In the transformer 1, each of the primary coil 10 and the secondary coil 20 is formed of a conductive material such as copper. Specifically, each of the primary coil 10 and the secondary coil 20 is formed such that a linear conductor is wound in a circular manner. The conductor constituting the primary coil 10 may be formed by a material having the same composition as or a material having a different composition from the conductor constituting the secondary coil 20; therefore, materials forming the conductors are not limited to the aforementioned material.

Both ends of the conductor constituting the primary coil 10 are connected to an external power source (not shown) so that the alternating current can be supplied to the primary coil 10 from the external power source. Both ends of the conductor constituting the secondary coil 20 are connected to an external device (not shown) to which the alternating current is supplied, so that an electric power can be supplied to the external device. A ratio of a number of winding turns of the primary coil 10 to a number of winding turns of the secondary coil 20 is determined based on a ratio of a voltage of the alternating current supplied to the primary coil 10 to a voltage of an alternating current supplied (outputted) from the secondary coil 20.

The primary coil 10 and the secondary coil 20 are arranged side by side and adjacent to each other in an axial direction of the primary coil 10 and the secondary coil 20 (up-and-down direction in FIG. 1), and arranged to have a predetermined distance apart from each other. The predetermined distance is preferably a following distance: the distance in which when the primary coil 10 and the secondary coil 20 are relatively moved in a direction (left-and-right direction in FIG. 1) perpendicular to the aforementioned axial direction, the primary coil 10 and the secondary coil 20 do not physically come into contact with each other; and the distance in which the secondary coil 20 and the core 30 are capable of receiving a magnetic flux generated by the primary coil 10.

Figure 2:
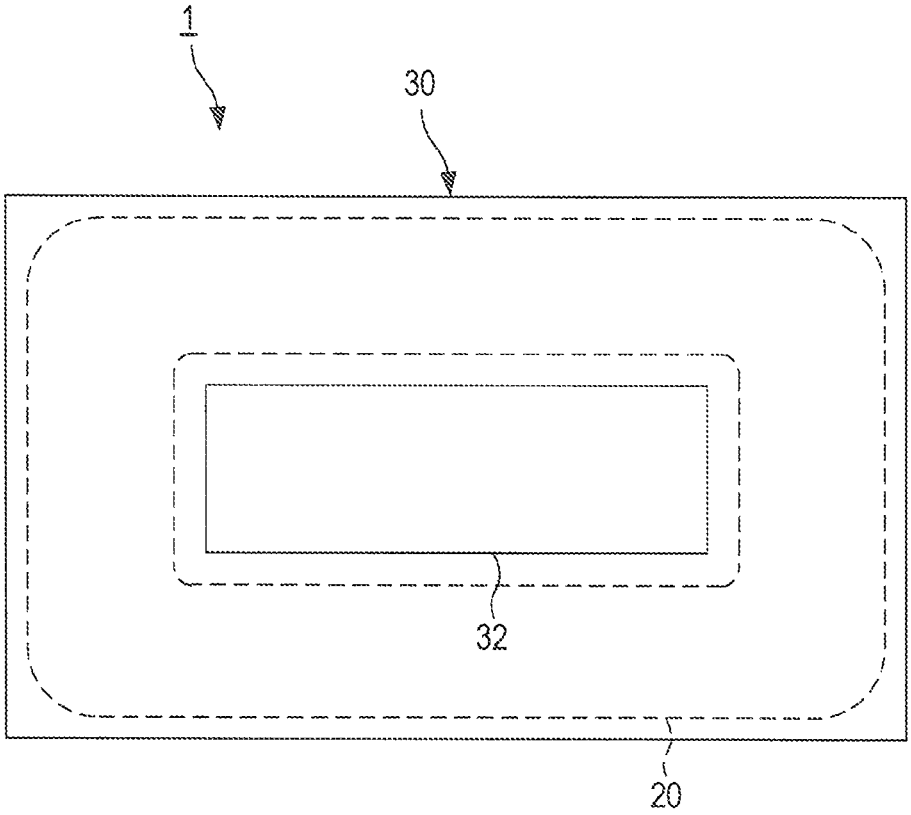
FIG. 2 is a plan view showing an overall configuration of the transformer in FIG. 1.
Figure 3:
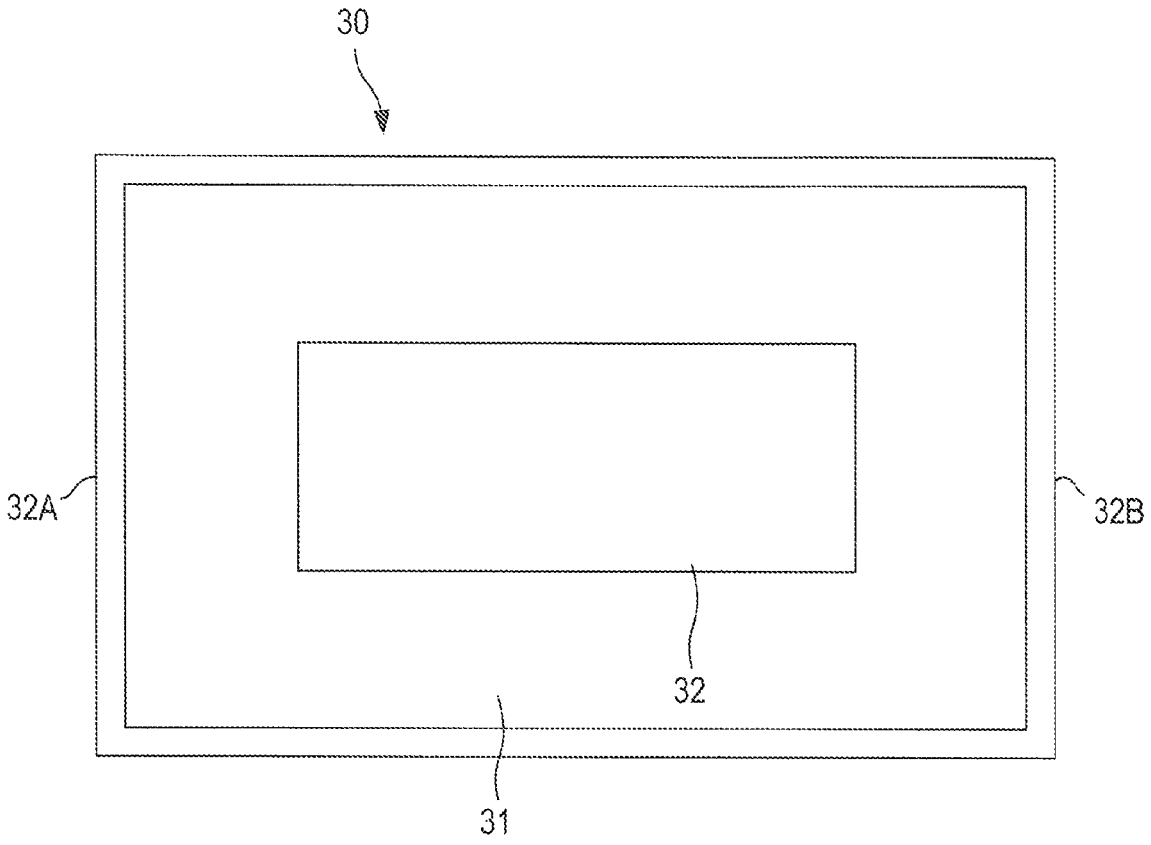
FIG. 3 is a view showing a core in FIG. 1 seen from a side of a primary coil.

Referring to FIG. 3, the core 30 is a plate-like iron core or magnetic core formed into a generally rectangular shape and configured to collect the magnetic flux generated by the primary coil 10. The core 30 is provided adjacent to the secondary coil 20 such that the secondary coil 20 is located between the core 30 and the primary coil 10. A plate-like member constituting the core 30 is preferably formed to have a thickness in which magnetic saturation of the core 30 does not occur and distribution of a magnetic flux inside the core 30 is uniform. As shown in FIGS. 1 to 3, the core 30 includes a conductor storage part 31 and a central part 32. The conductor storage part 31 is configured to store the secondary coil 20 therein. The central part 32 constitutes a central region of the core 30. The first embodiment will be explained with regard to an example in which the conductor storage part 31 is formed integrally with the central part 32.

The conductor storage part 31 is configured to store the secondary coil 20 therein. That is, the conductor storage part 31 is configured to store the conductor constituting the secondary coil 20. The conductor storage part 31 is formed of a plate member. The plate member has a concave cross section which extends in an annular manner. The conductor storage part 31 is provided such that an opening of the concave cross section opens in a direction from a side of the secondary coil 20 toward a side of the primary coil 10.

The central part 32 is a part located in an inner region (hereinafter, referred to as "central region") inward from the conductor storage part 31. The central part 32 has a recessed shape opening toward a direction opposite to the direction of the opening of the concave cross section of the conductor storage part 31. In other words, the central part 32 is a recessed part formed in an area where the conductor storage part 31 is not formed. The recessed part has a flat bottom face. The first embodiment will be explained with regard to an example in which the central part 32 is a flat plate-like part extending over the overall central region.

Next, operations in the transformer 1 constituted as above will be explained.

When an alternating current is supplied to the primary coil 10 from the external power source, a magnetic flux whose intensity changes as time progresses is generated around the primary coil 10, as shown by thin-line arrows in FIG. 1, due to the alternating current flowing through the primary coil 10. In an area where the magnetic flux is generated, the secondary coil 20 and the core 30 are arranged. The core 30 is configured to collect the magnetic flux generated by the primary coil 10.

Figure 25:
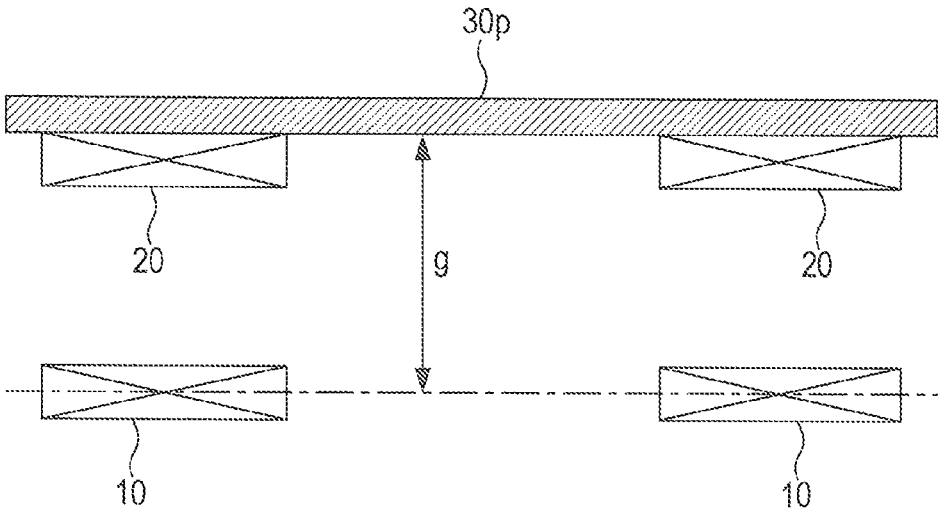
FIG. 25 is a schematic view showing a configuration of a transformer having a conventional flat plate-like core.

In the core 30 of the transformer 1 according to the first embodiment, a gap "G" from the primary coil 10 to the central part 32 can be made shorter than a gap "g" from the primary coil 10 to a flat plate-like core as shown in FIG. 25. By making the gap "G" be shorter as above, it becomes possible for the core 30 to more effectively collect the magnetic flux generated by the primary coil 10.

In the secondary coil 20, an alternating current is induced. The alternating current has an electric current value that changes as time progresses, according to a density of the magnetic flux that changes as time progresses. In other words, in the secondary coil 20, a voltage, which is transformed based on the ratio of the number of the winding turns of the primary coil 10 to the number of the winding turns of the secondary coil 20, is induced.

The core 30 of the transformer 1 according to the first embodiment makes it possible to shorten an electromagnetic gap, compared with the flat plate-like core shown in FIG. 25. The electromagnetic gap is a gap between the primary coil 10 and the core 30, specifically, the central part 32. Therefore, the core 30 can effectively collect the magnetic flux generated by the primary coil 10, resulting in an improved performance of the transformer 1. For example, the transformer 1 in the first embodiment can increase an inductive voltage by about 11%, compared with a transformer provided with the flat plate-like core shown in FIG. 25.

Figure 24:
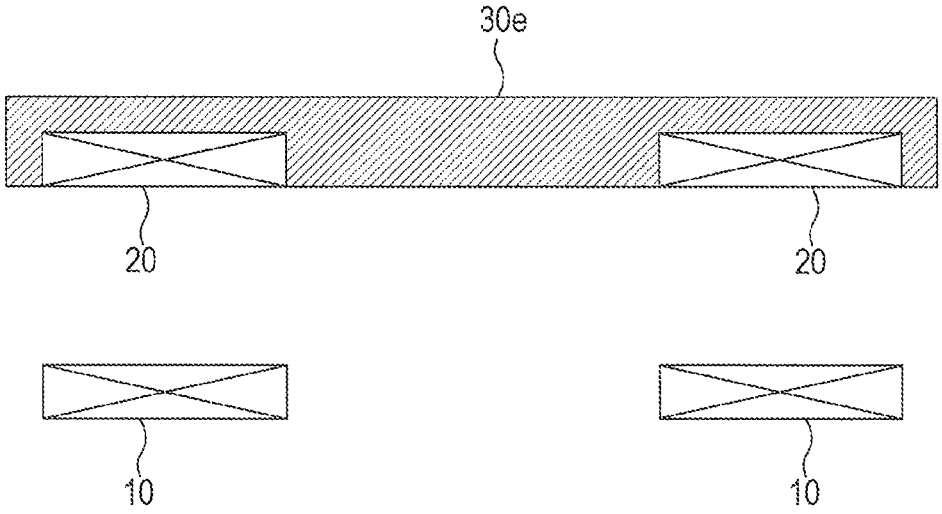
FIG. 24 is a schematic view showing a configuration of a transformer having a conventional E-type core.

Moreover, since the core 30 in the first embodiment includes the conductor storage part 31 and the central part 32 which are formed of the plate member, a part of the core, which does not contribute to a flux path, is reduced. Thus, a volume of the core 30 can be reduced compared with the E-type core as shown in FIG. 24. Consequently, it is possible to reduce a weight of the core 30 and therefore, a weight of the transformer 1.

Although the first embodiment has been explained with regard to an example in which the secondary coil 20 is wound in a generally rectangular shape and the core 30 is formed into a generally rectangular shape, the shape of the secondary coil 20 and the shape of the core 30 are not limited to the rectangular shape and may be, for example, a circular shape, an oval shape, or other shapes.

Figure 4:
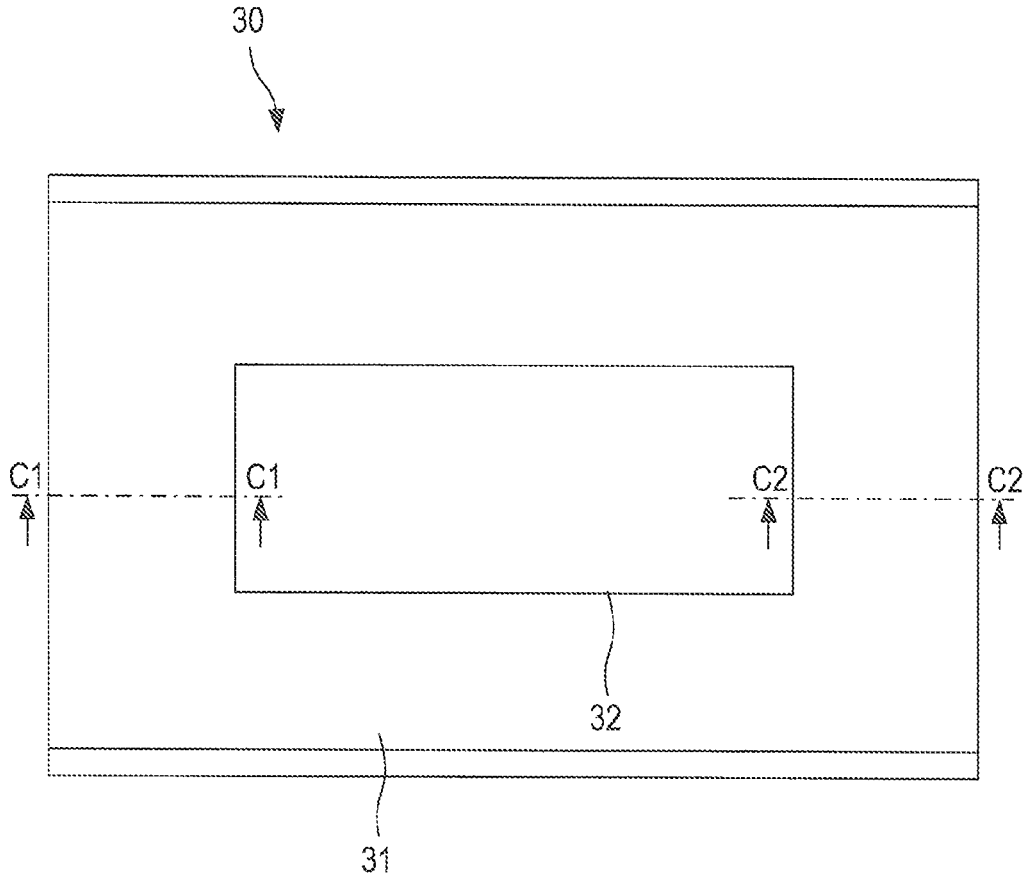
FIG. 4 is a view showing a core according to another example when seen from the side of the primary coil.

The core 30 may be formed such that the conductor storage part 31 has the concave cross section which extends in the annular manner, as in the above-explained embodiment. Alternatively, it may be possible to form the core 30 that does not include walls 32A and 32B shown in FIG. 3. Specifically, the core 30 may be formed as shown in FIG. 4. In other words, the conductor storage part 31 may be formed such that outer walls (the walls 32A and 32B) in a longitudinal direction are not provided. In this case, a cross section taken from a line C1-C1 and a cross section taken from a line C2-C2 in FIG. 4 have a substantially L-shape.

Specifically, in a case where each of the primary coil 10 and the secondary coil 20 is formed into the generally rectangular shape and a length of long sides of the rectangular shape in the primary coil 10 (length in the left-and-right direction in FIG. 4) is longer than a length of sides, which correspond to the long sides of the primary coil 10, of the secondary coil 20 (length in the left-and-right direction in FIG. 4), it is preferable that the core 30 (or the conductor storage part 31) does not include the walls 32A and 32B, as explained above.

By constituting as above, it is possible to minimize an influence due to a low efficiency in collecting the magnetic flux by the core 30, while reducing the weight of the core 30. That is, in the above-mentioned configuration, the efficiency in collecting the magnetic flux is lower in parts (the walls 32A and 32B) of the short sides of the core 30 than in other parts. Accordingly, the parts (the walls 32A and 32B) do not greatly affect the efficiency in collecting the magnetic flux. For example, even if the walls 32A and 32B are not provided, a lowered amount of the efficiency in collecting the magnetic flux is small. Thus, the influence due to the low efficiency in collecting the magnetic flux in the overall core 30 can be made minor. Meanwhile, since the volume of the core 30 can be made small by not providing the walls 32A and 32B, the weight of the core 30 can be reduced.

Second Embodiment

Next, a second embodiment of the present invention will be described with reference to FIGS. 5 to 8. A transformer according to the second embodiment has a basic configuration the same as that of the transformer in the first embodiment, except for a shape of the core. Therefore, in the second embodiment, explanations will be given with regard to the shape of the core and so on with reference to FIGS. 5 to 8 and will not be repeated with regard to the other constituent elements and the like.

Figure 5:
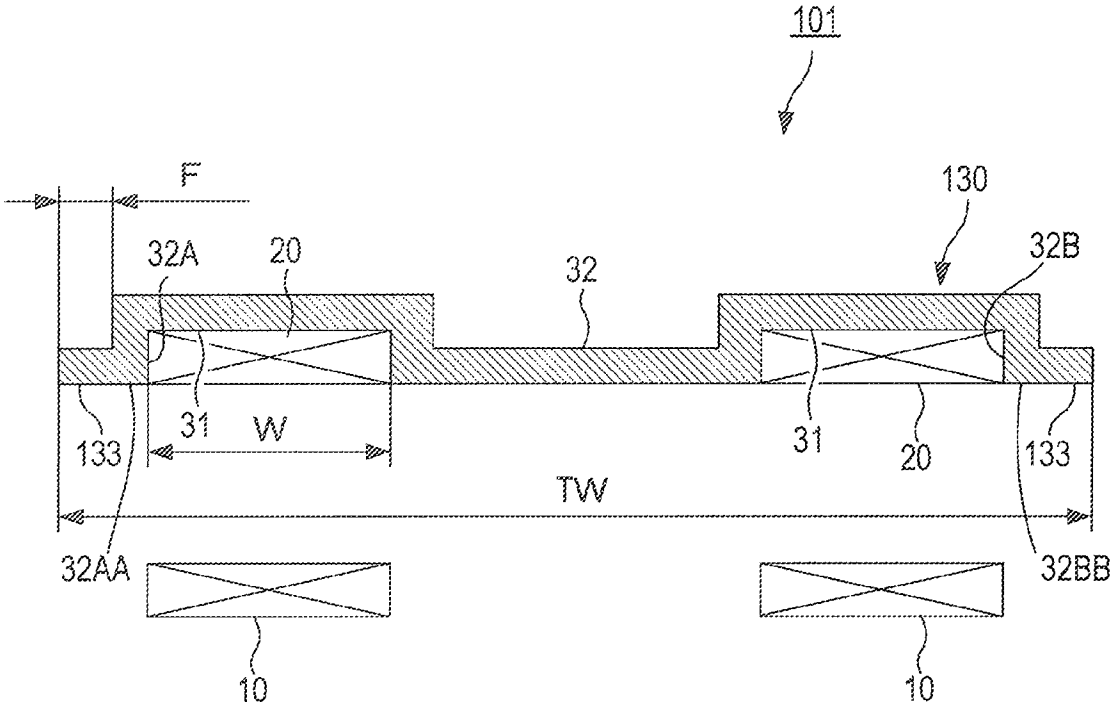
FIG. 5 is a cross-sectional view showing a configuration of a transformer according to a second embodiment of the present invention.

The transformer 101 according to the second embodiment is, as shown in FIG. 5, mainly composed of the primary coil 10, the secondary coil 20, and a core 130 provided in a vicinity of the secondary coil 20.

The core 130 is, in the same manner as the core 30 in the first embodiment, a plate-like iron core or magnetic core formed into a generally rectangular shape and configured to collect the magnetic flux generated by the primary coil 10. The core 130 is provided adjacent to the secondary coil 20 such that the secondary coil 20 is located between the core 130 and the primary coil 10. A plate-like member constituting the core 130 is preferably formed to have a thickness in which magnetic saturation does not occur in the core 130 and distribution of a magnetic flux inside the core 130 is uniform.

Figure 6:
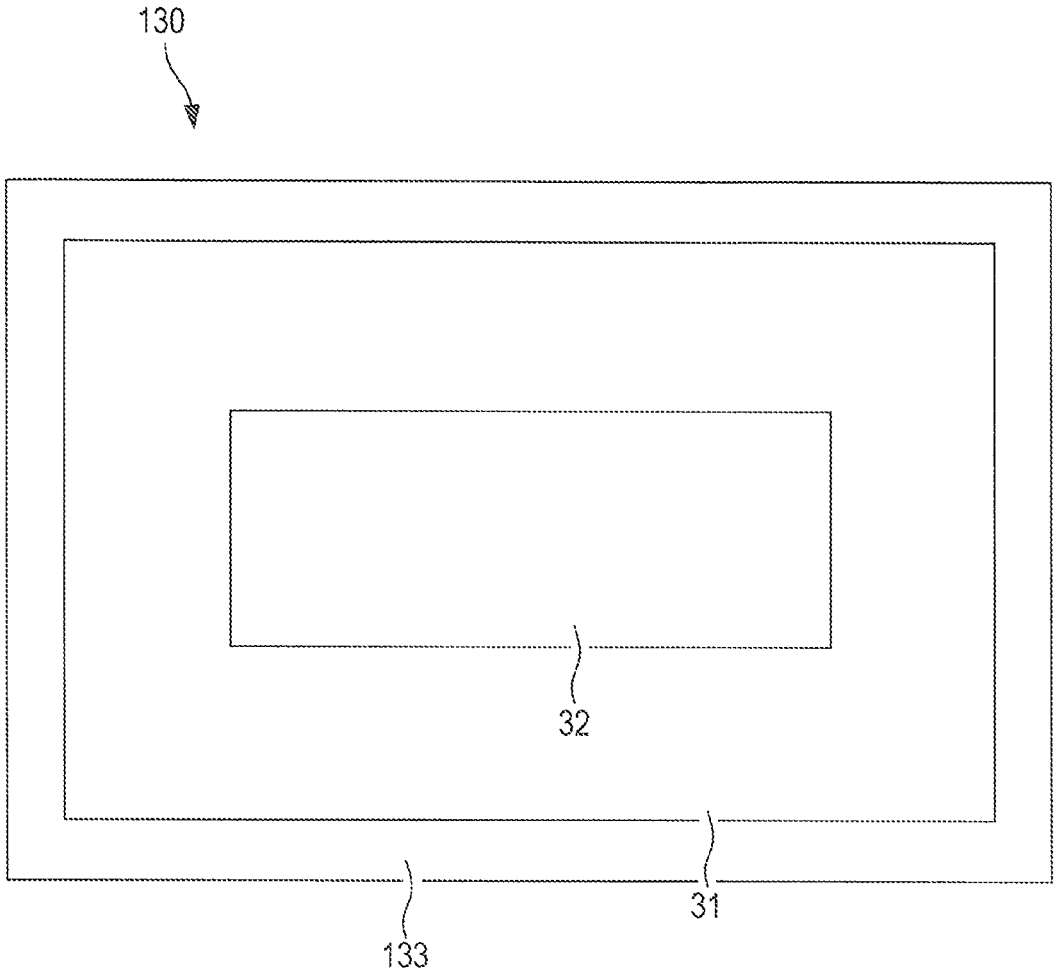
FIG. 6 is a view showing the core in FIG. 5 seen from a side of a primary coil.

FIG. 6 is a view showing the core 130 seen from the side of the primary coil 10 and illustrating a configuration of the core 130 of FIG. 5.

As shown in FIGS. 5 and 6, the core 130 includes the conductor storage part 31, the central part 32, and a flange portion 133 provided on a circumference of the core 130. The flange portion 133 extends outward from an outer opening edge (an end part 32AA of the wall 32A and an end part 32BB of the wall 32B) of opening edges of the conductor storage part 31, and is a flat plate-like member (part) extending outward from the outer opening edge of the conductor storage part 31. The second embodiment will be explained with regard to an example in which the conductor storage part 31, the central part 32, and the flange portion 133 are together formed integrally as one member.

Operations in the transformer 101 constituted as above are generally the same as those in the transformer 1 of the first embodiment, and therefore, will not be explained here.

Now, explanations will be given with regard to a relationship between an overhang length F of the flange portion 133 and improvement of an inductive voltage in the transformer 101, based on analysis results. The overhand length F is a length of a portion, protruding outward from the conductor storage part 31, of the flange portion 133.

The above-mentioned relationship will be explained with reference to FIG. 7.

Figure 7:
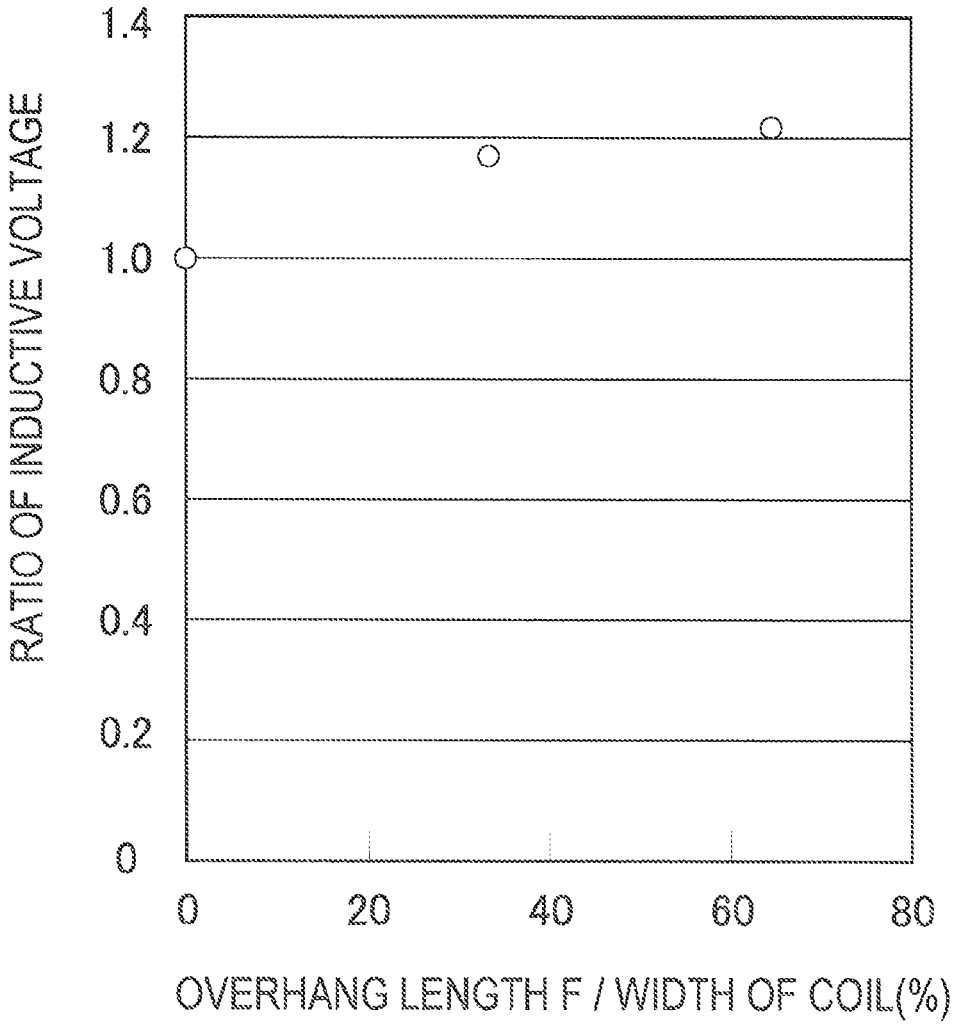
FIG. 7 is a graph illustrating a relationship between an overhang length F of a flange portion and an inductive voltage.

A horizontal axis of a graph in FIG. 7 shows the overhang length F expressed in percentage in relation to a coil width W of the secondary coil 20. A vertical axis the graph in FIG. 7 shows a ratio of the inductive voltage in the transformer 101 to the inductive voltage in the transformer 1 including the core 30 in the first embodiment. In the transformer 1, the overhang length F is 0%, i.e., the flange portion 133 is not provided.

In the graph of FIG. 7, a following tendency is shown: as the overhang length F increases, the ratio of the inductive voltage in the transformer 101 increases. While it may be considered to increase the overhang length F so as to increase the inductive voltage, the overhang length F is restricted by a width TW of the entire core 130 including the flange portion 133.

For example, when the overhang length F is around 30% of the coil width W of the secondary coil 20, the transformer 101 including the core 130 of the second embodiment can provide following improvements: the inductive voltage can be improved by around 17%, compared with the transformer 1 including the core 30 of the first embodiment, and further, can be improved by around 30%, compared with the transformer including the flat plate-like core shown in FIG. 25.

According to the aforementioned configuration, the core 130 in the second embodiment can more effectively collect the magnetic flux extending between the primary coil 10 and the secondary coil 20, compared with the core 30 without the flange portion 133 in the first embodiment. Consequently, an improved performance of the transformer 101 in the second embodiment can be achieved.

In other words, by providing the flange portion 133, it becomes possible to reduce a magnetic resistance in the magnetic flux generated by the primary coil 10, thereby reducing a leakage flux. Consequently, the improved performance of the transformer 101 in the second embodiment can be achieved.

Another example (another configuration) of the core 130 in FIG. 6 will be described with reference to FIG. 8.

Figure 8:
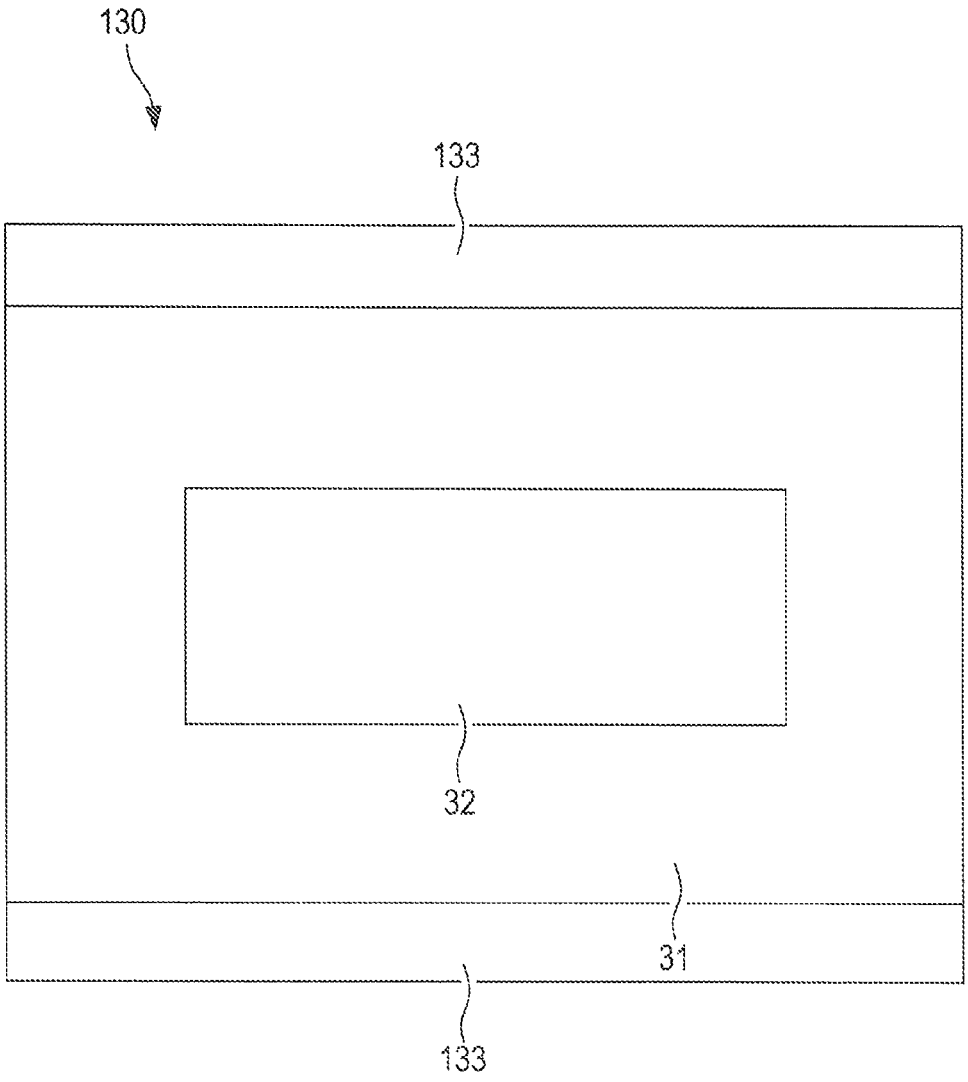
FIG. 8 is a view showing a configuration of the core of FIG. 6 according to another example seen from the side of the primary coil.

In the core 130 of FIG. 8, the flange portions 133 are provided only on a pair of opposite sides of the core 130.

In the core 130 of FIG. 8, the flange portion 133 may be provided on the circumference of the core 130 as in the aforementioned embodiment.

Specifically, in a case where each of the primary coil 10 and the secondary coil 20 is formed into a generally rectangular shape and a length of long sides of the rectangular shape in the primary coil 10 (length in a left-and-right direction in FIG. 8) is longer than a length of sides, which correspond to the long sides of the primary coil 10, of the secondary coil 20 (length in the left-and-right direction in FIG. 8), it is preferable to provide the flange portion 133 only on long sides of the core 130, that is, upper and lower sides of the core 130 in FIG. 8.

Third Embodiment

Next, a third embodiment of the present invention will be described with reference to FIG. 9. A transformer according to the third embodiment has a basic configuration the same as that of the transformer in the second embodiment, except for a shape of the core. Therefore, in the third embodiment, explanations will be given with regard to the shape of the core and so on with reference to FIG. 9 and will not be repeated with regard to the other constituent elements and the like.

Figure 9:
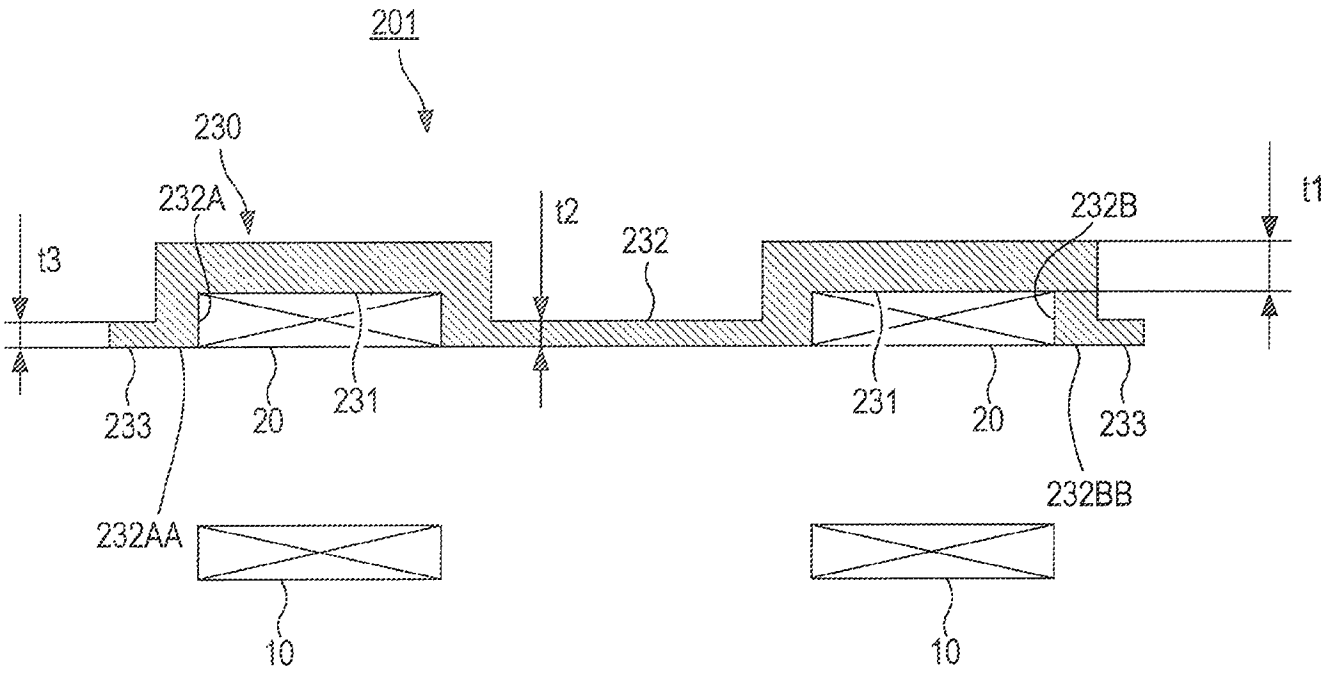
FIG. 9 is a cross-sectional view showing a configuration of a transformer according to a third embodiment of the present invention.

FIG. 9 is a cross-sectional view showing a configuration of the transformer 201 according to the third embodiment. The transformer 201 according to the third embodiment is mainly composed of the primary coil 10, the secondary coil 20, and a core 230 provided in a vicinity of the secondary coil 20.

The core 230 is, in the same manner as the core 30 in the first embodiment, a plate-like iron core or magnetic core formed into a generally rectangular shape and configured to collect the magnetic flux generated by the primary coil 10. The core 230 is provided adjacent to the secondary coil 20 such that the secondary coil 20 is located between the core 230 and the primary coil 10.

The core 230 includes, as shown in FIG. 9, a conductor storage part 231, a central part 232, and a flange portion 233 provided on a circumference of the core 230. The conductor storage part 231 is configured to store the secondary coil 20 therein. The central part 232 constitutes a central region of the core 230.

The conductor storage part 231 is, in the same manner as the conductor storage part 31 in the first embodiment, configured to store the secondary coil 20 therein. The central part 232 is, in the same manner as the central part 32 in the first embodiment, a part located in an inner region inward from the conductor storage part 231. The central part 232 forms a recessed shape opening toward a direction opposite to a direction of an opening of the concave cross section of the conductor storage part 231. In the same manner as the flange portion 133 in the second embodiment, the flange portion 233 extends outward from an outer opening edge (an end part 232AA of a wall 232A and an end part 232BB of a wall 232B) of opening edges of the conductor storage part 231, and is a flat plate-like member extending outward from the outer opening edge of the conductor storage part 231.

The core 230 in third embodiment is different from the respective cores in the first and second embodiments with regard to a following point: a plate thickness "t1" of a plate member constituting the conductor storage part 231 is thicker than a plate thickness "t2" of a plate member constituting the central part 232 and also than a plate thickness "t3" of a plate member constituting the flange portion 233.

Here, the above-mentioned plate thickness t2 and plate thickness t3 may be a thickness in which distribution of a magnetic flux is uniform in the core 230. For example, the plate thickness t2 may be equal to or different from the plate thickness t3. Moreover, the plate thickness t2 may be equal to or thinner than a thickness of the central part 32 in the first and second embodiments. Similarly, the plate thickness t3 may be equal to or thinner than a thickness of the flange portion 133 in the second embodiment.

According to the above configuration, the core 230 according to the third embodiment makes it possible to inhibit magnetic saturation from occurring in the conductor storage part 231 arranged close to the secondary coil 20 where an electric current flows.

For example, in the core 130 of the transformer 101 in the second embodiment, if an electric current of 350 A-turn rms/mm (effective value) is applied, magnetic saturation occurs in the core 130. When the inductive voltage becomes lower due to a lower magnetic permeability of the core 130 or when a resonance circuit is formed as a circuit to be connected to the secondary coil 20 (secondary circuit), there may be a problem in which the secondary current flowing in the secondary coil 20 and the secondary circuit is not stable due to change in inductance.

On the other hand, in the core 230 of the third embodiment, a plate thickness only of the conductor storage part 231 is made to be thick; the conductor storage part 231 is positioned at around the secondary coil 20 where a magnetic flux by the secondary current flowing into the secondary coil 20 is concentrated. Therefore, it is possible to inhibit magnetic saturation from occurring in the core 230 and achieve a uniform distribution of the magnetic flux in the core 230. Moreover, since the plate thickness of the core 230 is made to be thick only at the part where the magnetic flux is concentrated, a weight increase of the core 230 can be inhibited, compared with a case where a plate thickness of the entire core 230 is thick.

When there is a uniform distribution of the magnetic flux in the core 230, heat generation mainly due to hysteresis loss can be inhibited in the core 230. Moreover, when there is a uniform distribution of the magnetic flux, generation of spots where the magnetic flux is particularly concentrated in the core 230 can be inhibited and therefore, the heat generation due to the hysteresis loss can be inhibited in the above-mentioned spots where the magnetic flux is concentrated. Consequently, an (localized) increase of temperature can be inhibited from occurring in the core 230 and restriction of the flowing current in the coil due to the increase of temperature is less likely to be occurred. As a result, it becomes possible to inhibit an efficiency of the transformer 201 from decreasing.

Fourth Embodiment

Next, a fourth embodiment of the present invention will be described with reference to FIGS. 10 to 13. A transformer according to the fourth embodiment has a basic configuration the same as that of the transformer in the third embodiment, except for a shape of the core. Therefore, in the fourth embodiment, explanations will be given with regard to the shape of the core and so on with reference to FIGS. 10 to 13 and will not be repeated with regard to the other constituent elements and the like.

Figure 10:
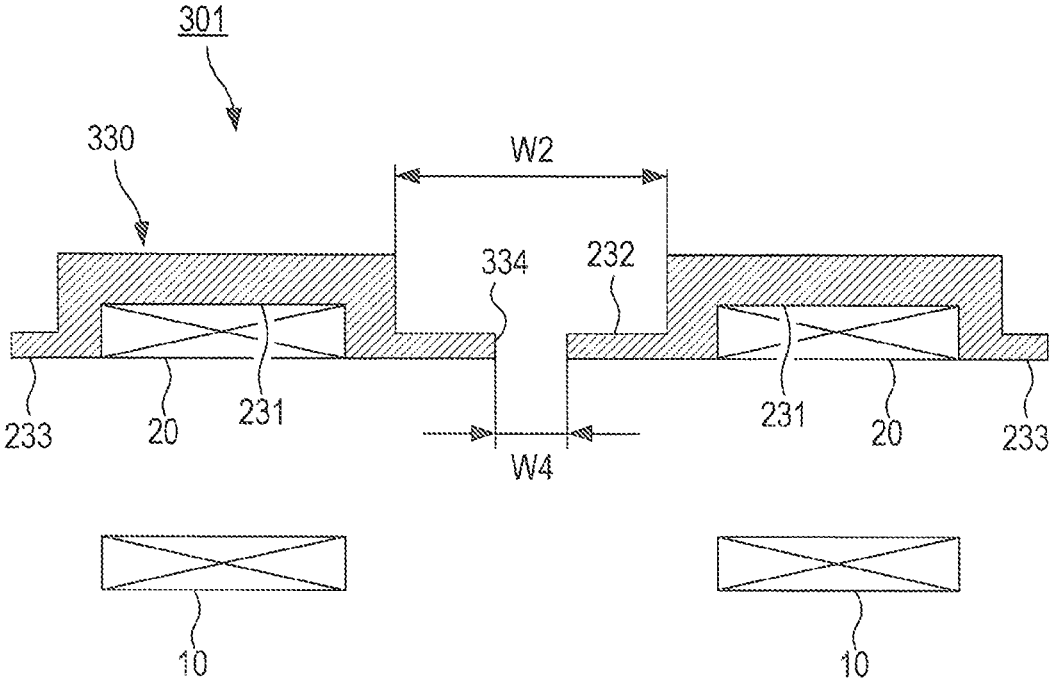
FIG. 10 is a cross-sectional view showing a configuration of a transformer according to a fourth embodiment of the present invention.
Figure 11:
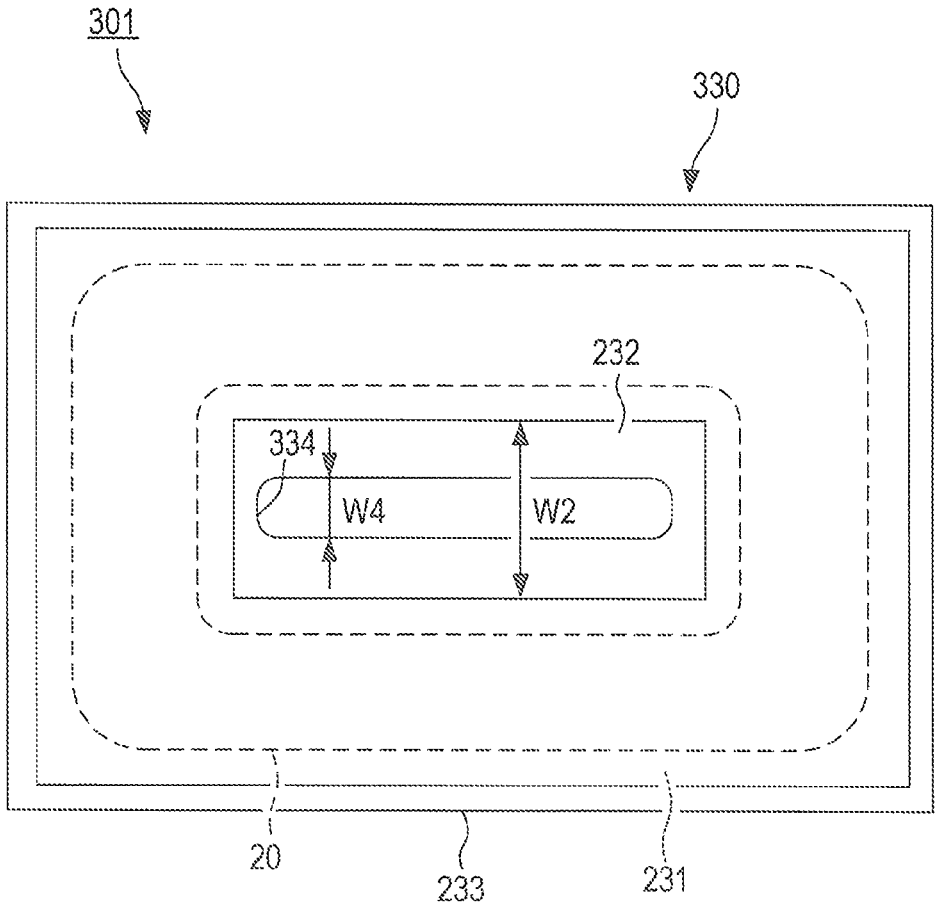
FIG. 11 is a plan view showing an overall configuration of the transformer in FIG. 10.

The transformer 301 according to the fourth embodiment is, as shown in FIGS. 10 and 11, mainly composed of the primary coil 10, the secondary coil 20, and a core 330 provided in a vicinity of the secondary coil 20.

The core 330 is, in the same manner as the core 230 in the third embodiment, a plate-like iron core or magnetic core formed into a generally rectangular shape and configured to collect the magnetic flux generated by the primary coil 10. The core 330 is provided adjacent to the secondary coil 20 such that the secondary coil 20 is located between the core 330 and the primary coil 10.

The core 330 includes the conductor storage part 231, the central part 232, the flange portion 233, and an aperture 334. The conductor storage part 231 is configured to store the secondary coil 20 therein. The central part 232 constitutes a central region of the core 330. The flange portion 233 is provided on a circumference of the core 330. The aperture 334 is formed in the central part 232.

The aperture 334 is a through-hole formed in the central part 232 for the purpose of reducing a weight of the core 330. The fourth embodiment will be explained with regard to an example in which the aperture 334 is formed as one through-hole in a rectangular shape which is the same as an overall shape of the core 330; however, the shape of the aperture 334 is not limited to the rectangular shape and may be a circular shape or an oval shape. Moreover, a number of the aperture 334 formed in the central part 232 is not limited to one and may be more than one.

Here, explanations will be given with regard to a relationship between a reduced amount of a volume of the core 330 as a result of providing the aperture 334 and the inductive voltage in the secondary coil 20, based on analysis results. Specifically, explanations will be given with regard to a relationship between a ratio of a width W4 of the aperture 334 to a width W2 of the central part 232 in FIG. 11, and the inductive voltage in the secondary coil 20.

Figure 12:
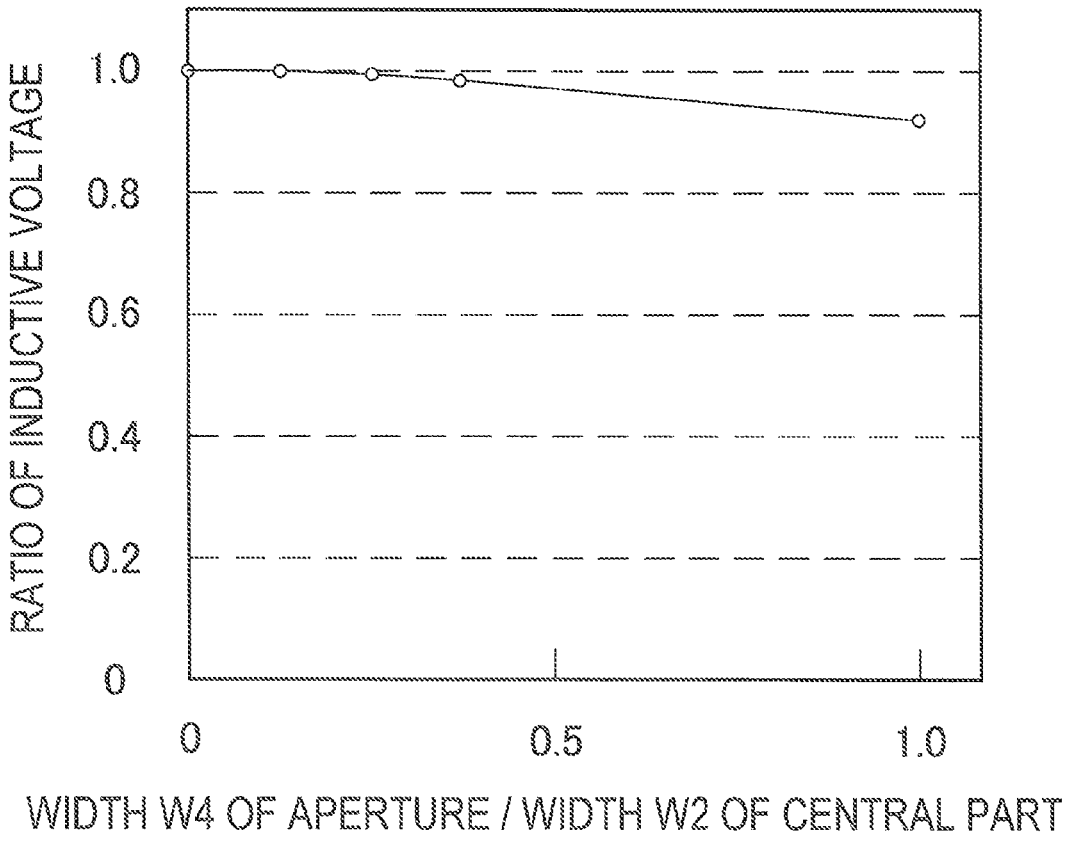
FIG. 12 is a graph illustrating a relationship between a ratio of a width W4 of an aperture to a width W2 of a central part, and an inductive voltage in a secondary coil.

FIG. 12 is a graph illustrating the aforementioned relationship.

A horizontal axis of the graph in FIG. 12 shows the ratio of the width W4 of the aperture 334 to the width W2 of the central part 232. A vertical axis of the graph in FIG. 12 shows a ratio of the inductive voltage in the secondary coil 20 of the fourth embodiment to the inductive voltage in the secondary coil 20 of the third embodiment. In the secondary coil 20 of the third embodiment, a ratio of the aperture 334 is 0, i.e., the aperture 334 is not provided.

In the graph of FIG. 12, a following tendency is shown: as the ratio of the aperture 334 increases from 0 toward 1, the ratio of the inductive voltage in the secondary coil 20 gradually decreases. For example, when the ratio of the aperture 334 is 0.3, i.e., the volume of the core 330 is reduced by around 30% in the central part 232, the inductive voltage in the secondary coil 20 decreases by around 1%.

According to the aforementioned configuration, the weight of the core 330 in the fourth embodiment can be reduced as a result of forming the aperture 334 in the central part 232. Moreover, the central part 232 has a lower efficiency in collecting the magnetic flux existing between the primary coil 10 and the secondary coil 20, compared with the conductor storage part 231. Therefore, even if the aperture 334 is formed in the central part 232, influence due to decrease of the inductive voltage in the secondary coil 20 can be made minor.

Figure 13:
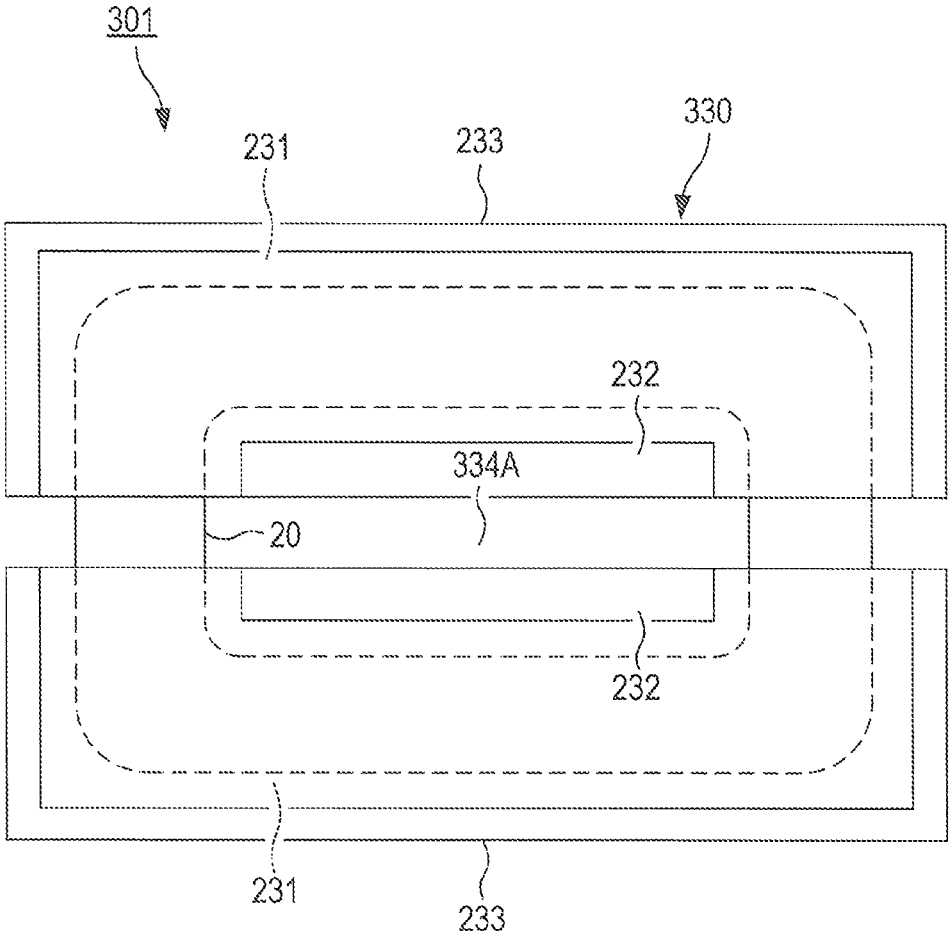
FIG. 13 is a plan view showing an overall configuration of another example of the core in FIG. 11.

The above-mentioned embodiment has been explained with regard to an example in which the aperture 334 is formed only in the central part 232; however, in a case where each of the primary coil 10 and the secondary coil 20 is formed into a generally rectangular shape and a length of long sides of the rectangular shape in the primary coil 10 (length in a left-and-right direction in FIG. 13) is longer than a length of sides, which correspond to the long sides of the primary coil 10, of the secondary coil 20 (length in the left-and-right direction in FIG. 13), a clearance part 334A may be formed so as to divide the core 330 into two parts, thereby dividing the core 330 into two parts, i.e., an upper part and a lower part as shown in FIG. 13.

Fifth Embodiment

Next, a fifth embodiment of the present invention will be described with reference to FIG. 14. A transformer according to the fifth embodiment has a basic configuration the same as that of the transformer in the second embodiment, except for a shape of the core. Therefore, in the fifth embodiment, explanations will be given with regard to the shape of the core and so on with reference to FIG. 14 and will not be repeated with regard to the other constituent elements and the like.

Figure 14:
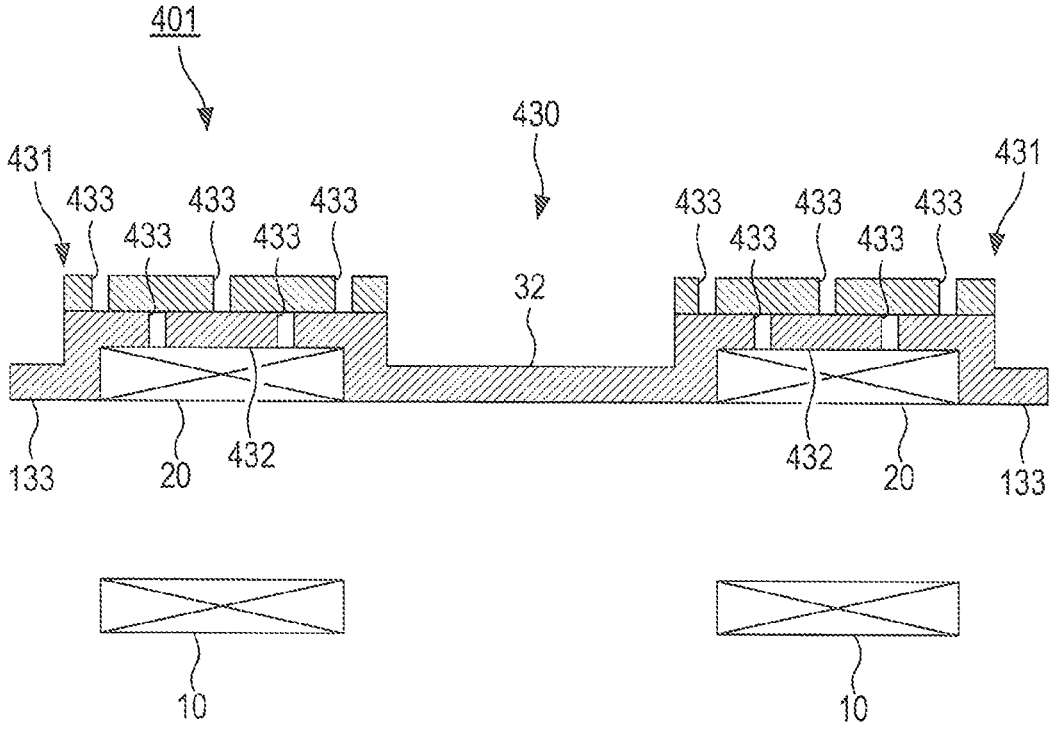
FIG. 14 is a cross-sectional view showing a configuration of a transformer according to a fifth embodiment of the present invention.

The transformer 401 according to the fifth embodiment is, as shown in FIG. 14, mainly composed of the primary coil 10, the secondary coil 20, and a core 430 provided in a vicinity of the secondary coil 20.

The core 430 is, in the same manner as the core 30 in the first embodiment, a plate-like iron core or magnetic core formed into a generally rectangular shape and configured to collect the magnetic flux generated by the primary coil 10. The core 430 is provided adjacent to the secondary coil 20 such that the secondary coil 20 is located between the core 430 and the primary coil 10.

The core 430 mainly includes a conductor storage part 431, the central part 32, and the flange portion 133. The conductor storage part 431 is configured to store the secondary coil 20 therein.

In the same manner as the conductor storage part 31 in the first embodiment, the conductor storage part 431 is configured to store the secondary coil 20 therein. The conductor storage part 431 is a part of a plate member and the part has a concave cross section extending in an annular manner.

The conductor storage part 431 is provided such that an opening of the concave cross section opens in a direction from a side of the secondary coil 20 toward a side of the primary coil 10.

In the conductor storage part 431 of the fifth embodiment, a bottom plate part 432 (part located in an upper side in FIG. 14) located between side walls of the concave cross section is formed of two plate members which are stacked together. In these two plate members constituting the bottom plate part 432, a plurality of groove-like slits 433 are formed. The groove-like slits 433 are configured to divide the two plate members into a plurality of sections. The aforementioned two plate members are stacked together in such a manner that the slits 433 formed in one of the two plate members do not overlap with any of the slits 433 formed in the other of the two plate members, thereby constituting the bottom plate part 432.

In the fifth embodiment, the plate member located at the side of the secondary coil 20 (a lower side in FIG. 14) (hereinafter, "secondary coil 20-side plate member") has two slits 433 formed at an equal interval thereon, while the plate member located at an outer side (an upper side in FIG. 14) (hereinafter, "outer-side plate member") has three slits 433 at an equal interval thereon. Explanations will be given with regard to an example in which these two plate members are stacked together such that the slits 433 formed in the secondary coil 20-side plate member and the slits 433 formed in the outer-side plate member are located in an alternating manner.

Next, operations in the conductor storage part 431 of the core 430, which are features of the transformer 401 in the fifth embodiment, will be explained. The other operations in the transformer 401 are the same as those in the transformer 1 of the first embodiment and the transformer 101 of the second embodiment, and therefore, will not be explained.

For example, in a case where a large amount of the electric current flows in the secondary coil 20, heat generation due to iron loss in the core 430 is large. Thus, heat expansion occurs in the core 430. Thereafter, when the flow of the electric current in the secondary coil 20 stops, the heat generation in the core 430 also stops; then, the core 430 is contracted. Such a heat expansion and contraction in the core 430 are absorbed by expansion or contraction of widths of the respective slits 433 in the conductor storage part 431.

Meanwhile, since the slits 433 formed in the secondary coil 20-side plate member and the slits 433 formed in the outer-side plate member are positioned in an alternating manner, a flux path of a magnetic field in the conductor storage part 431 can be formed without passing through spaces in the slits 433, i.e., formed by bypassing the slits 433.

Specifically, the flux path of the magnetic field can be made to bypass the slits 433 formed in the secondary coil 20-side plate member by passing through the outer-side plate member. Also, the flux path of the magnetic field can be made to bypass the slits 433 formed in the outer-side plate member by passing through the secondary coil 20-side plate member.

According to the above configuration, when the core 430 is expanded or contracted due to a temperature change of the core 430, such an expansion or contraction of the core 430 can be absorbed by the spaces in the respective slits 433. It is, therefore, possible to alleviate compression stress and tensile stress acting on the plate members constituting the core 430. Particularly, when the core 430, the secondary coil 20 and others are fixed to a case (not shown) which is a chassis constituting the transformer 401, compression stress and tensile stress due to the temperature change act strongly on the core 430; however, the core 430 according to the fifth embodiment can alleviate the above-mentioned stresses. Therefore, the core 430 according to the fifth embodiment can inhibit defects such as cracks in the core 430 due to the temperature change, etc. from occurring.

Furthermore, since the flux path of the magnetic field in the conductor storage part 431 is formed by bypassing the slits 433, it is possible to minimize for the spaces in the slits 433 to become a large magnetic resistance. Accordingly, decrease in efficiency of the transformer 401 of the fifth embodiment can be minimized.

Sixth Embodiment

Next, the sixth embodiment of the present invention will be described with reference to FIGS. 15 and 16. A transformer according to the sixth embodiment has a basic configuration the same as that of the transformer in the first embodiment, except for a shape of the core. Therefore, in the sixth embodiment, explanations will be given with regard to the shape of the core and so on with reference to FIGS. 15 and 16 and will not be repeated with regard to the other constituent elements and the like.

Figure 15:
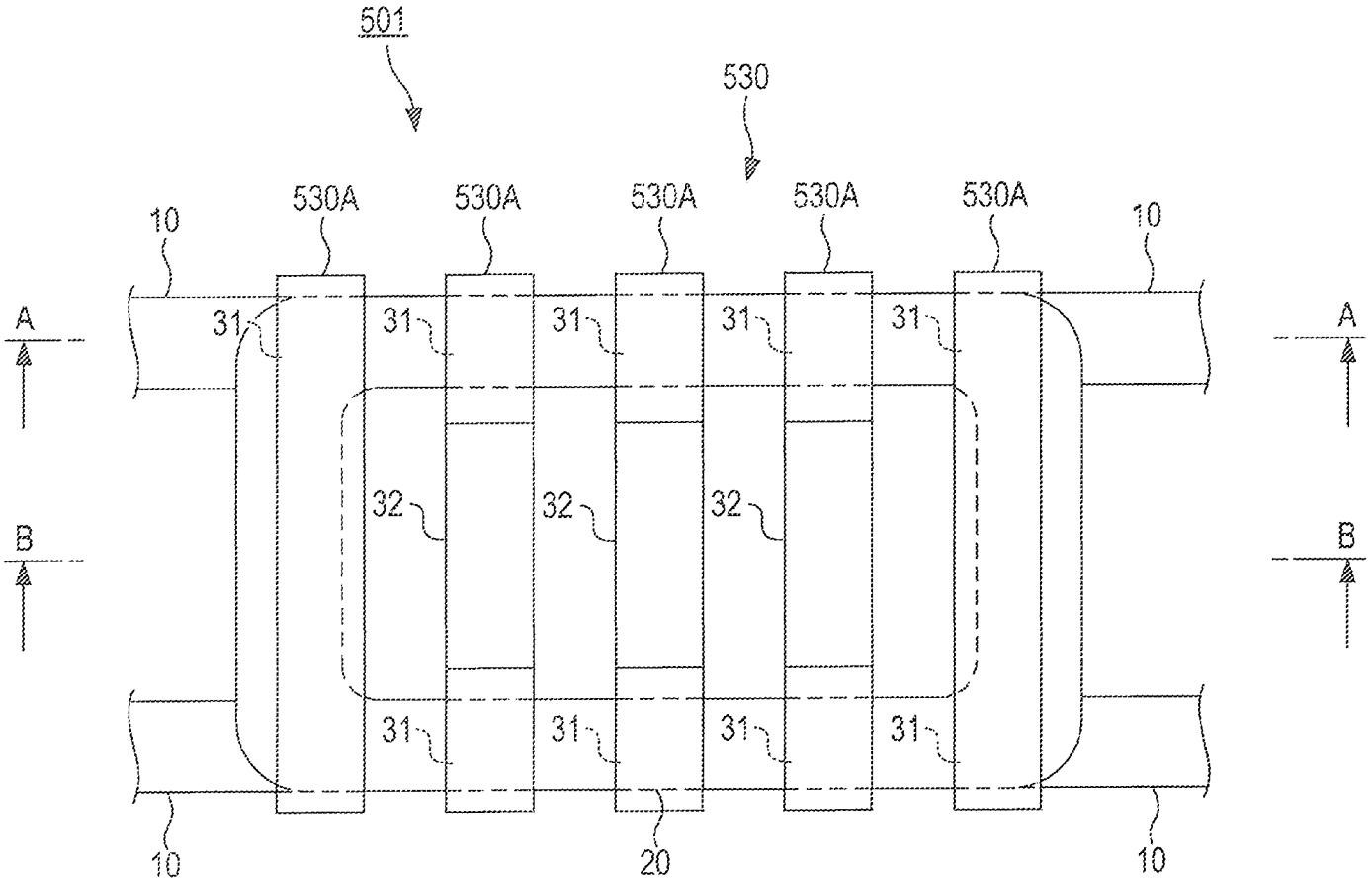
FIG. 15 is a plan view showing an overall configuration of a transformer according to a sixth embodiment of the present invention.

The transformer 501 according to the sixth embodiment is, as shown in FIG. 15, mainly composed of the primary coil 10, the secondary coil 20, and a core 530 provided in a vicinity of the secondary coil 20.

The core 530 is composed of a plurality of core segments 530A arranged to be spaced apart from one another. Each of the core segments 530A is a plate-like iron core or magnetic core formed into a generally strip-like shape. The core 530 is configured to collect the magnetic flux generated by the primary coil 10. The core 530 is provided adjacent to the secondary coil 20 such that the secondary coil 20 is located between the core 530 and the primary coil 10.

In each of the core segments 530A, a part of the conductor storage part 31 and a part of the central part 32 are arranged, so that the conductor storage part 31 and the central part 32 are provided to the core 530 as a whole.

In the sixth embodiment, a length of the primary coil 10 in a long-side direction thereof is longer than a length in of the secondary coil 20 in a long-side direction; the core segments 530A extend along an intersecting direction, more preferably an orthogonal direction, to a pair of two sides extending in the aforementioned long-side direction of the primary coil 10. Furthermore, the plurality of core segments 530A are arranged at a predetermined distance apart from one another along the aforementioned long-side direction (an extending direction of the pair of the two sides).

In order to inhibit increase of magnetic resistance, it is desirable that the above-mentioned predetermined distance is generally proportional to a plate thickness of plate members each constituting each of the core segments 530A. In other words, in a cross section taken from a plane (line A-A in FIG. 15) which is parallel to the aforementioned long-side direction and which passes through the secondary coil 20, the predetermined distance and the plate thickness of each of the plate members are desirably set such that a cross-sectional area of the core 530 is substantially the same as a cross-sectional area of the core 30 in the first embodiment and so on. Moreover, in a cross section taken from a line B-B in FIG. 15, the predetermined distance and the plate thickness of each of the plate members may be set such that the cross-sectional area of the core 530 is substantially the same as the cross-sectional area of the core 30 in the first embodiment and so on.

The sixth embodiment will be explained with regard to an example in which the predetermined distance is substantially the same as a width of each of the core segments 530A in the aforementioned long-side direction and in which the plate thickness of each of the plate members each constituting the core segments 530A is generally twice as thick as a plate thickness of the core 30 in the first embodiment.

By constituting the core 530 as above, it is possible to inhibit performance of the transformer 501 with regard to an inductive voltage, etc. from decreasing, compared with a following case: the core is divided without increasing the plate thickness of the plate member constituting the core, into the core segments 530A and these core segments 530A are arranged at a distance, substantially the same as the width of each of the core segments 530A, apart from one another. However, as discussed later, as the distance between the arranged core segments 530A (hereinafter, "arrangement distance") is increased, a leakage flux in the core 530 increases even if the plate thickness of each of the plate members constituting the respective core segments 530A is made to be thick. Consequently, the inductive voltage decreases.

A relationship between the distance ("arrangement distance") between the core segments 530A of FIG. 15 and an inductive voltage ratio will be explained with reference to FIG. 16.

Figure 16:
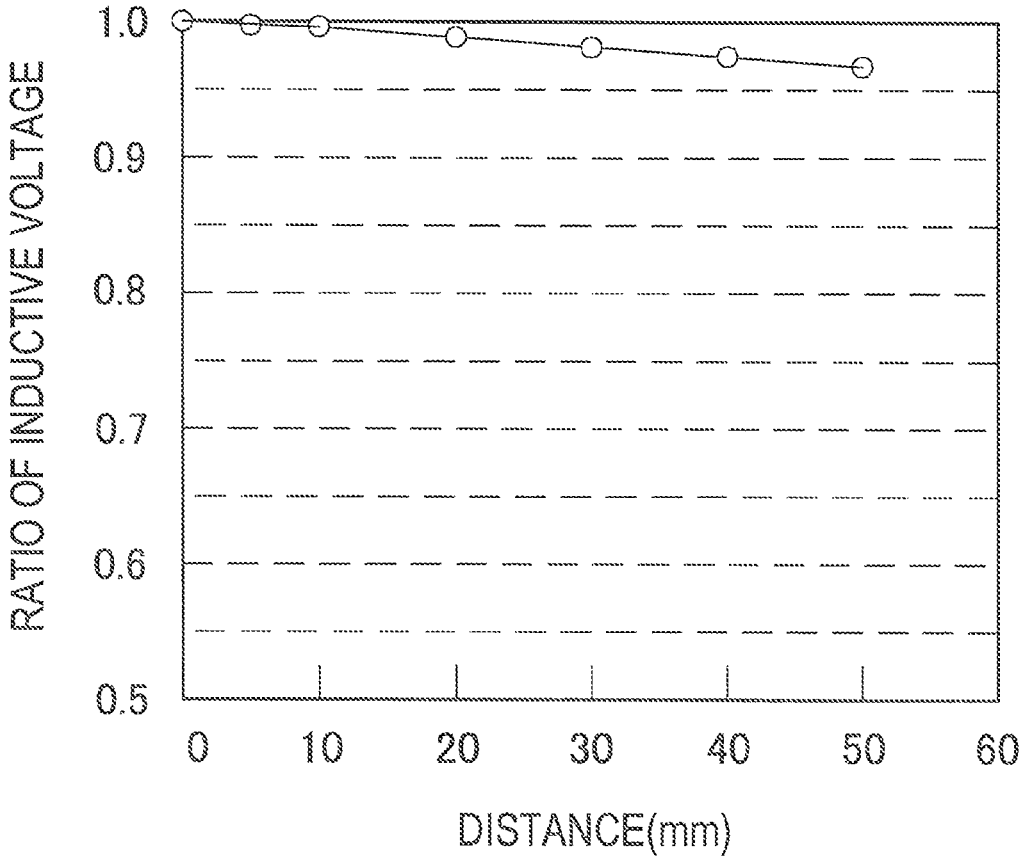
FIG. 16 is a graph illustrating a relationship between a distance between core segments in FIG. 15, and an inductive voltage ratio.

A horizontal axis of a graph in FIG. 16 shows the arrangement distance of the core segments 530A, while a vertical axis shows a ratio of the inductive voltage of the sixth embodiment to an inductive voltage in a case where the arrangement distance is 0 mm. In FIG. 16, when the arrangement distance is 0 mm, the plate thickness is 3 mm; and when the arrangement distance is not 0 mm, the plate thickness is 6 mm. The width of the plate member is equal to the arrangement distance. Accordingly, for example, when the arrangement distance is 10 mm, the width of the plate member is 10 mm. When the arrangement distance is 30 mm, the width of the plate member is 30 mm. In other words, a ratio of the arrangement distance to the width of the plate member is 1:1, and therefore, a removal ratio is 50%.

In FIG. 16, a following tendency is shown: as the arrangement distance of the core segments 530A increases, the leakage flux increases, causing a gradual decrease of the inductive voltage. For example, when the arrangement distance is 30 mm, the inductive voltage is decreased by about 1.5%. This decrease does not cause a problem in which the performance of the transformer 501 is decreased.

It may be configured that, in proportion to the increase of the arrangement distance, the plate thickness of the plate member is made to increase, so that a volume of a material constituting the core 530 stays a certain amount. However, the core 530 is not limited to this configuration.

According to the above-explained configuration, the core 530 can be composed of the plurality of core segments 530A each of which is relatively small in size, compared with an integrally formed core as in the core 30 in the first embodiment. Therefore, relatively small plate members can be used to manufacture the core 530. Compared with obtaining large plate members, obtaining the small plate members is easy and less expensive. Thus, manufacturing costs of the transformer 501 in the sixth embodiment can be reduced.

Moreover, compared with the core 30 of the first embodiment, the plate members each having a thicker plate thickness can be used to constitute the core. In this regard, there is a case where a required plate thickness of a plate member to constitute an integrally-formed core is thinner than a minimum plate thickness of a commercially-available plate member. In this case, it is necessary to obtain and grind such a commercially-available plate member to the extent that a plate thickness of this commercially-available plate member becomes the required plate thickness. Consequently, a problem arises in which manufacturing costs for the core becomes expensive.

However, in the configuration in which the core segments 530A are arranged at the predetermined distance apart from one another as in the core 530 according to the sixth embodiment, a required plate thickness of the plate member constituting the core segments 530A can be made thicker, compared with the required thickness in the integrally-formed core. In other words, the plate thickness of the plate member constituting the core segments 530A can be made to be generally equal to the plate thickness of the commercially-available plate member. Accordingly, a manufacturing step for grinding the plate member as explained above can be omitted or simplified. As a result, cost reduction in manufacturing the transformer 501 of the sixth embodiment can be achieved.

For example, in a case where an electric current of about 800 A-turn rms (effective value) is applied to a winding of the secondary coil 20, if the plate member constituting the integrally-formed core has a plate thickness of 2 mm, magnetic saturation would occur. In this case, it is necessary to have at least 3 mm of the plate thickness of the conductor storage part 31. Meanwhile, since it is necessary to make the plate thickness of the plate member be thinner so as to achieve a weight reduction of the integrally-formed core, the plate member having a minimum required plate thickness of 3 mm may be selected. However, if ferrite as a member constituting the core has a standard manufactured thickness of more than 3 mm, e.g., more than 5 mm, it is necessary to grind the material having the thickness of more than 3 mm, e.g., more than 5 mm, to the extent that the thickness becomes 3 mm in order to manufacture the core using the plate member with the thickness of 3 mm.

However, in the case where the core segments 530A are arranged at the predetermined distance apart from one another as in the core 530 of the sixth embodiment, the plate thickness of each of the plate members constituting the respective core segment 530A can be set as 6 mm. Accordingly, as mentioned above, the step for grinding the obtained plate member so as to have the required plate thickness can be omitted or simplified.

As a method for adjusting the thickness of the core without the step for grinding, as described in Patent Document 1, a following method is known: rectangular plate members are stacked upon one another in an overlapping manner to form a core. However, when the plate members are overlapped and bonded together, there is a problem in which a performance of the transformer may be degraded due to a very small space between bonded faces. On the other hand, the core 530 of the sixth embodiment is composed of the core segments 530A formed without bonding the plate members together, and therefore, can inhibit performance of the transformer 501 from degrading due to the space between the bonded face.

Moreover, by forming the core segments 530A in a strip-like shape (rectangular shape), it is easy to deal with the core 530 of a larger size, compared with forming the core segments 530A in a square shape. A manufacturable size of the core is determined, for example, depending on a shape or an area of a forming board where a shape of the core is formed. If the forming board has a round face, the manufacturable size for the core to be formed into a rectangular shape is determined by a length of a diagonal line in the core. In this case, if the core segment 530A is formed into the strip-like shape, it is possible to form a longer core segment 530A compared with the core segment 530A formed into the square shape.

As above, compared with the core segment 530A formed into the square shape, the core segment 530A formed into the strip-like shape can more easily deal with expansion of the distance between a pair of two sides (up side and bottom side in FIG. 15) of the primary coil 10. Moreover, since each of the core segments 530A has the same shape, the core segment 530A can be manufactured by using a single mold for molding. Therefore, mass manufacturing of the core segments 530A can be easily achieved and cost reduction in manufacturing the core 530 can be achieved.

Figure 17:
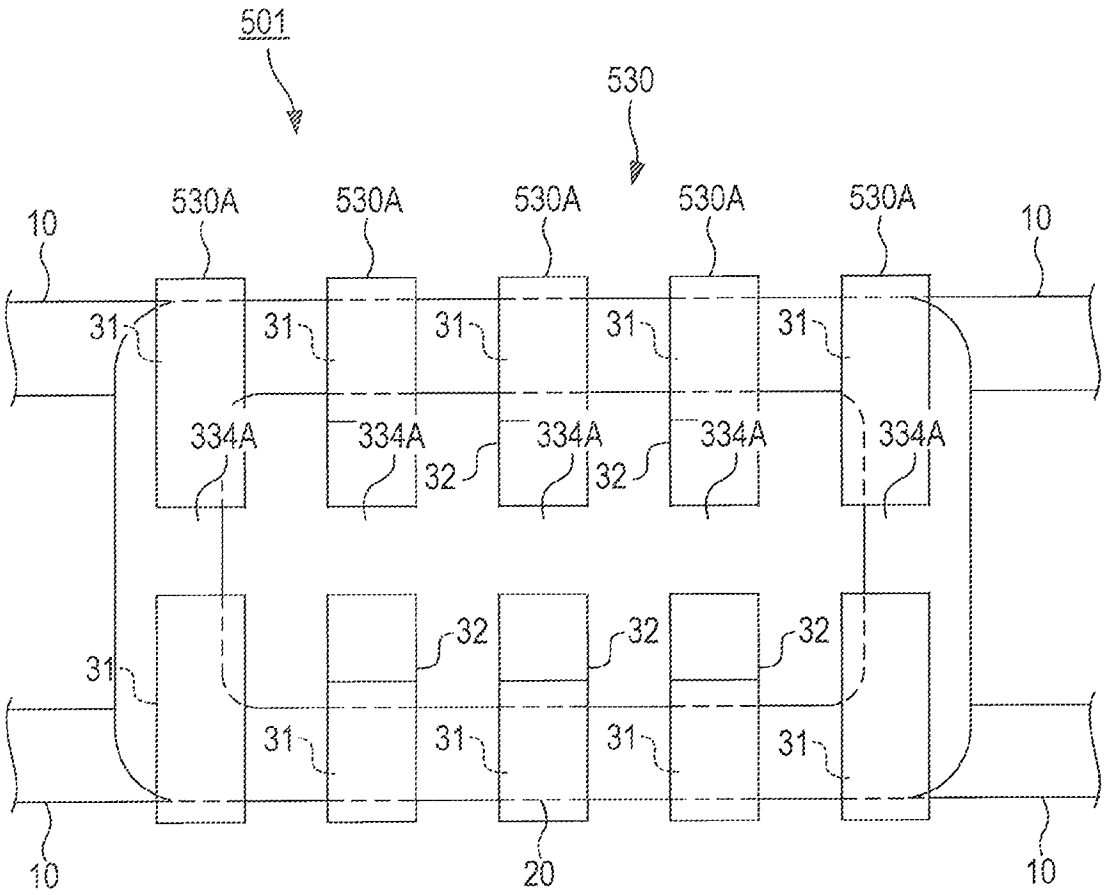
FIG. 17 is a view showing an overall configuration of a transformer in FIG. 15, according to another example.

As in the above-explained embodiment, the core 530 in which the plurality of the core segments 530A are arranged to be spaced apart from one another may be used. Also, as shown in FIG. 17, the core 530 may be divided into two parts by providing a clearance part 334A such that each of the core segments 530A is divided into two parts.

Seventh Embodiment

Next, the seventh embodiment of the present invention will be described with reference to FIG. 18. A transformer according to the seventh embodiment has a basic configuration the same as that of the transformer in the first embodiment, except for a shape of the core. Therefore, in the seventh embodiment, explanations will be given with regard to the shape of the core and so on with reference to FIG. 18 and will not be repeated with regard to the other constituent elements and the like.

Figure 18:
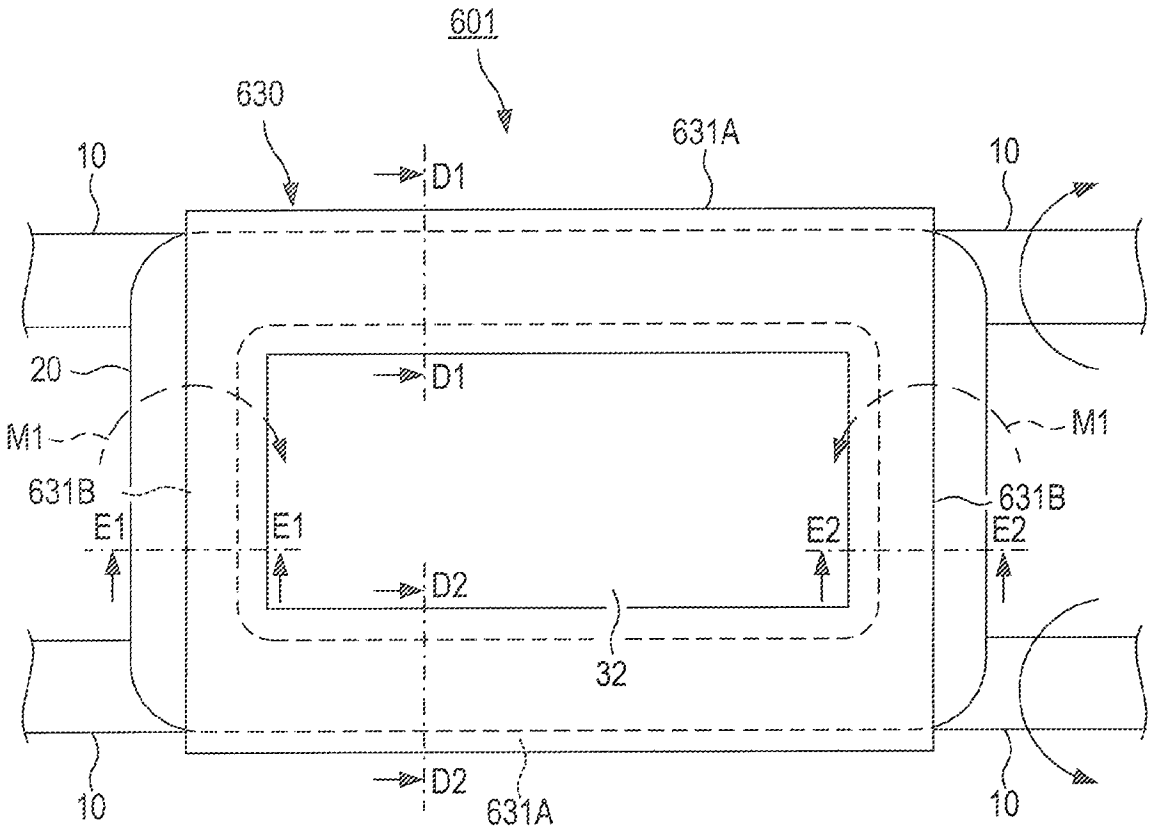
FIG. 18 is a plan view showing an overall configuration of a transformer according to a seventh embodiment of the present invention.

The transformer 601 according to the seventh embodiment is, as shown in FIG. 18, mainly composed of the primary coil 10, the secondary coil 20, and a core 630 provided in a vicinity of the secondary coil 20. In the seventh embodiment, a length of the primary coil 10 in a long-side direction (left-and-right direction in FIG. 18) is longer than a length of the secondary coil 20 in a long-side direction.

The core 630 is, in the same manner as the core 30 in the first embodiment, a plate-like iron core or magnetic core formed into a generally rectangular shape and configured to collect the magnetic flux generated by the primary coil 10. The core 630 is provided adjacent to the secondary coil 20 such that the secondary coil 20 is located between the core 630 and the primary coil 10.

The core 630 mainly includes conductor storage parts 631A and 631B, and the central part 32. Each of the conductor storage parts 631A and 631B is configured to store the secondary coil 20 therein.

In the same manner as the conductor storage part 31 in the first embodiment, the conductor storage part 631A is configured to store a coil winding forming the secondary coil 20 therein. The conductor storage part 631A has a concave cross section (a cross section taken from a line D1-D1, and a cross section taken from a line D2-D2 in FIG. 18) and is arranged along a pair of two sides (upper side and lower side in FIG. 18) of the primary coil 10 in the aforementioned long-side direction. Furthermore, the conductor storage part 631A is provided such that an opening of the concave cross section opens in a direction from a side of the secondary coil 20 toward a side of the primary coil 10.

The conductor storage part 631B has an L-shaped cross section (a cross section taken from a line E1-E1, and a cross section taken from a line E2-E2 in FIG. 18) and is arranged along an intersecting direction, more preferably an orthogonal direction, to the aforementioned pair of two sides. The seventh embodiment will be explained with regard to an example in which, when the core 630 is seen in a plan view, the conductor storage part 631B covers generally a half of a coil width of the secondary coil 20. As mentioned above, the conductor storage part 631B may generally cover the half of the coil width of the secondary coil 20. Also, the conductor storage part 631B may cover at least a part of the coil winding constituting the secondary coil 20. Thus, a portion of the secondary coil 20 to be covered by the conductor storage part 631B is not specifically limited to the above constitution.

Next, operations in the core 630, which are features of the transformer 601 in the seventh embodiment, will be explained. The other operations in the transformer 601 are the same as those in the transformer 1 of the first embodiment, and therefore will not be explained.

An area of the conductor storage part 631B does not contribute to increase of an interlinkage magnetic flux M1 passing across the secondary coil 20. Therefore, even if the conductor storage part having the concave cross section is provided in the aforementioned area as in the first embodiment, this area does not contribute to improvement of the performance of the transformer. Moreover, an outer part of the core, which is located outward from short sides of the secondary coil 20 (sides extending in an up-and-down direction in FIG. 18), constitutes a flux path that does not interlink with the secondary coil 20; therefore, the outer part of the core does not contribute to improvement of the performance of the transformer.

On the other hand, if the aforementioned area of the conductor storage part 631B is completely removed, a magnetic flux which does not interlink with the secondary coil 20 increases. Therefore, a voltage induced by the secondary coil 20 decreases, thereby lowering a performance of the transformer 601.

Therefore, as in the core 630 of the seventh embodiment, the generally half of the coil winding of the secondary coil 20 is covered by the conductor storage part 631B, so that a magnetic flux adjacent to the conductor storage part 631B among a magnetic flux generated in the primary coil 10 is drawn toward the core 630. Thereby, the drawn magnetic flux can be made as a magnetic flux interlinking with the secondary coil 20. Consequently, the transformer 601 of the seventh embodiment can slightly increase the inductive voltage, compared with the transformer 1 of the first embodiment.

According to the above configuration, the conductor storage part 631B has the shape in which the outer portion located outward from the secondary coil 20 is removed; thus, a weight of the core 630 can be reduced. Moreover, the aforementioned outer portion has low efficiency in collecting the magnetic flux existing between the primary coil 10 and the secondary coil 20, compared with other portions of the core 630. Therefore, even when the conductor storage part 631B is formed such that the aforementioned outer portion is removed, influence due to decrease of the inductive voltage in the secondary coil 20 can be made minor.

The transformer of the present invention may be configured as shown in FIGS. 19 to 23.

Figure 19:
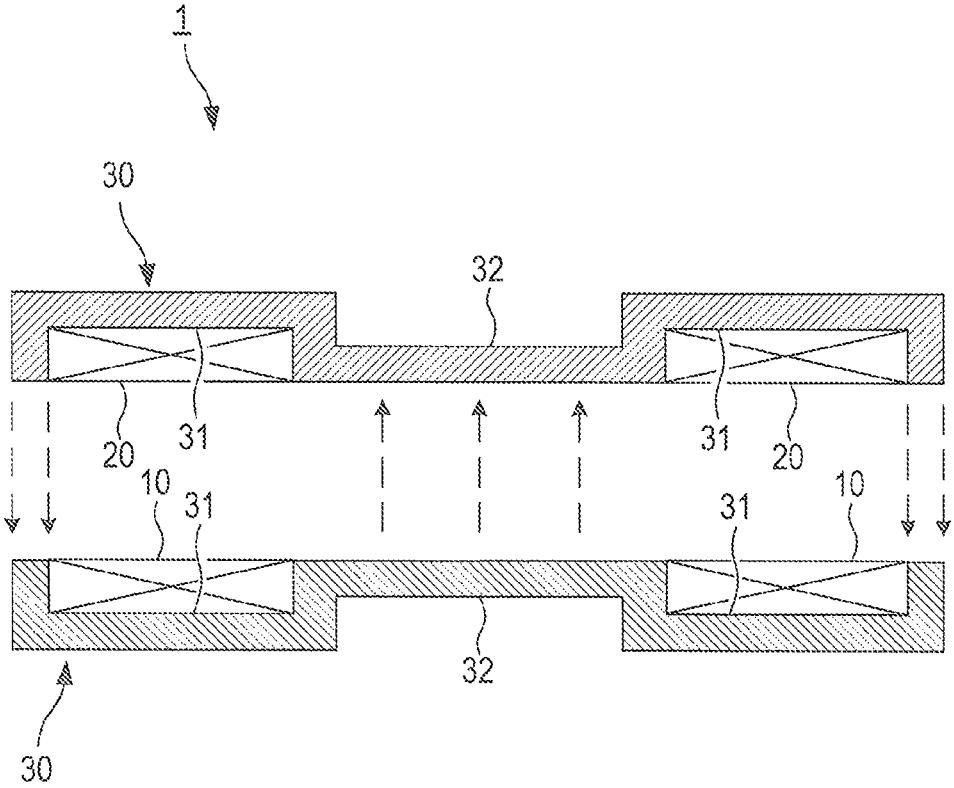
FIG. 19 is a view showing a modification of the present invention.

FIG. 19 shows a configuration of the transformer 1 in FIG. 1 in which another core 30 is also provided at the side of the primary coil 10.

Figure 20:
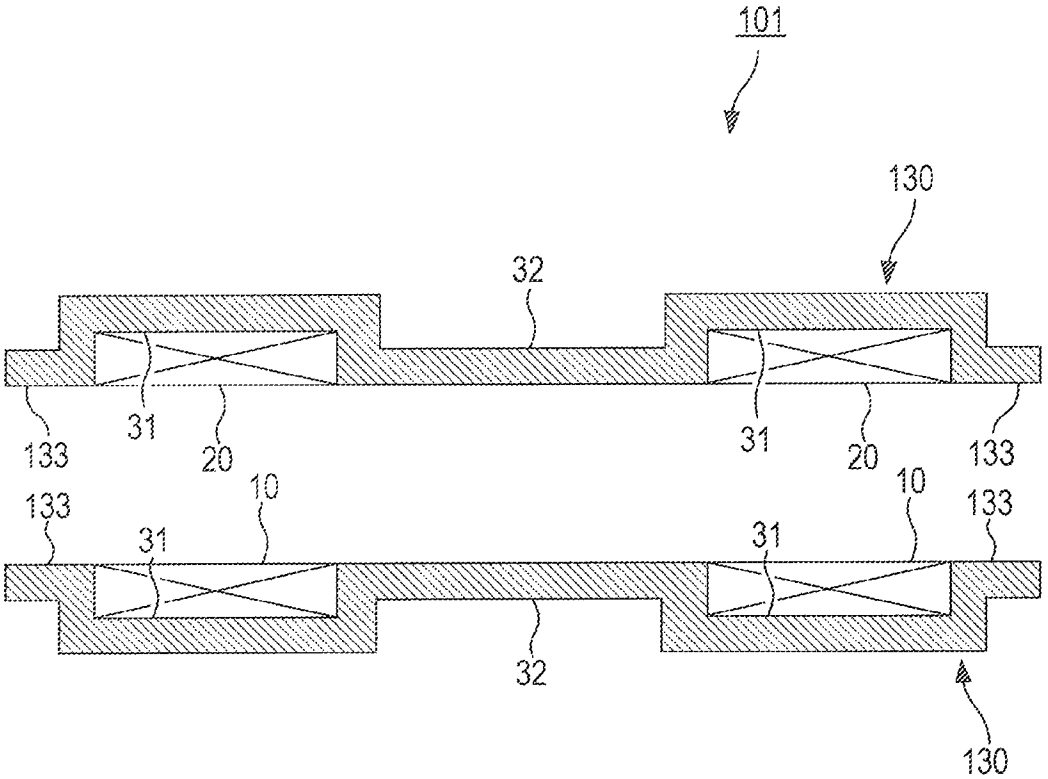
FIG. 20 is a view showing a modification of the present invention.

FIG. 20 shows a configuration of the transformer 101 in FIG. 5 in which another core 130 is also provided at the side of the primary coil 10.

Figure 21:
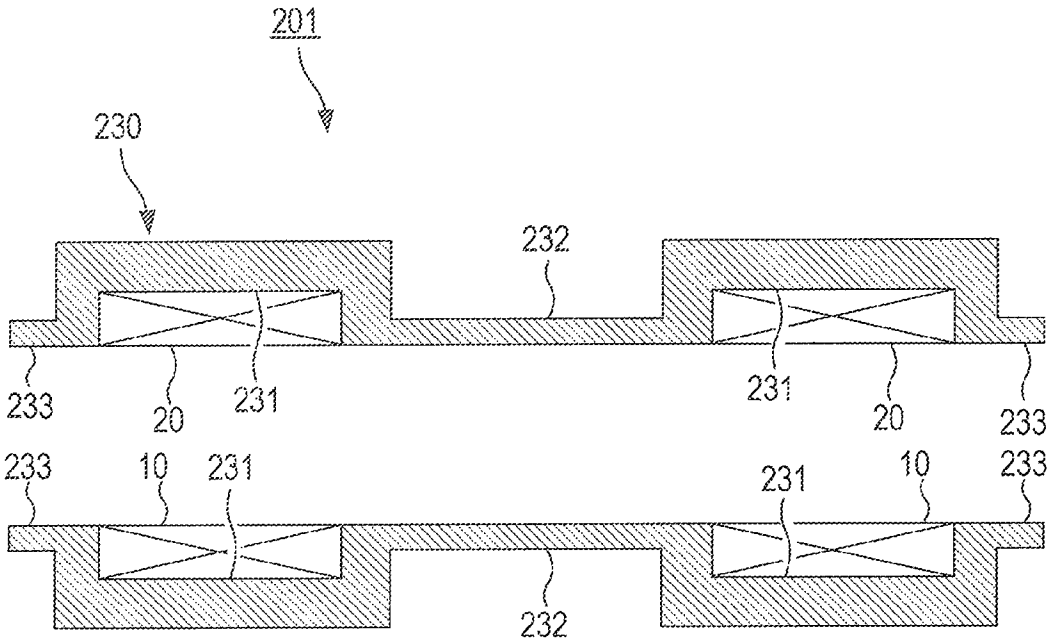
FIG. 21 is a view showing a modification of the present invention.

FIG. 21 shows a configuration of the transformer 201 in FIG. 9 in which another core 230 is also provided at the side of the primary coil 10.

Figure 22:
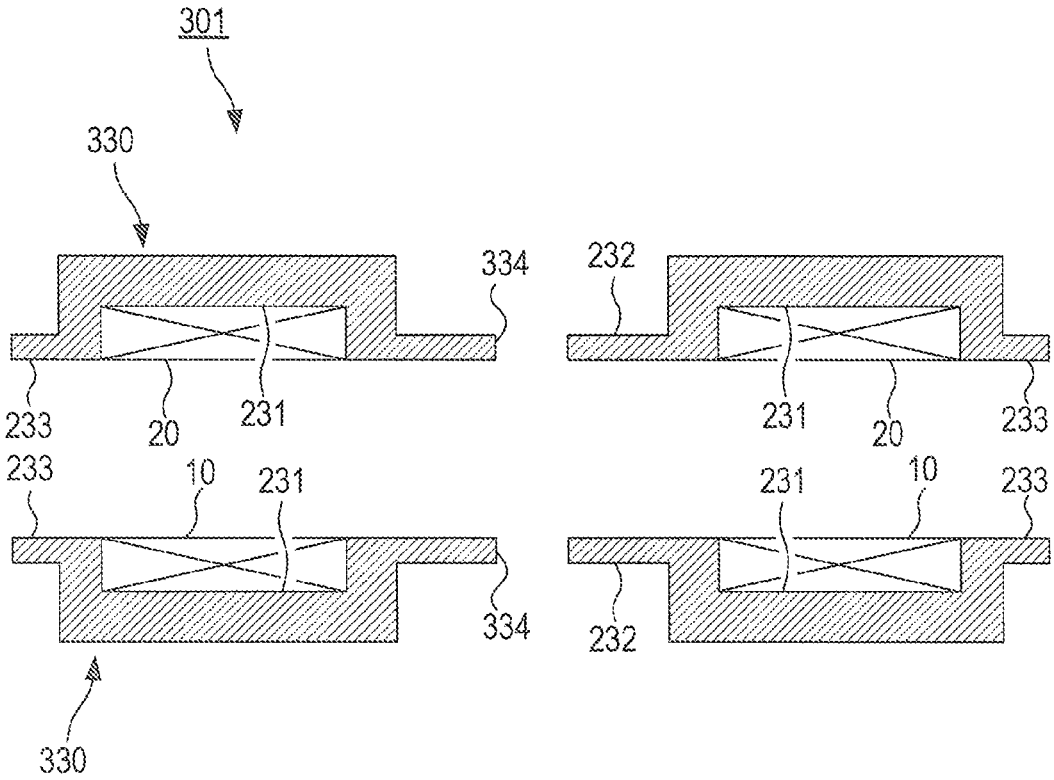
FIG. 22 is a view showing a modification of the present invention.

FIG. 22 shows a configuration of the transformer 301 in FIG. 10 in which another core 330 is also provided at the side of the primary coil 10.

Figure 23:
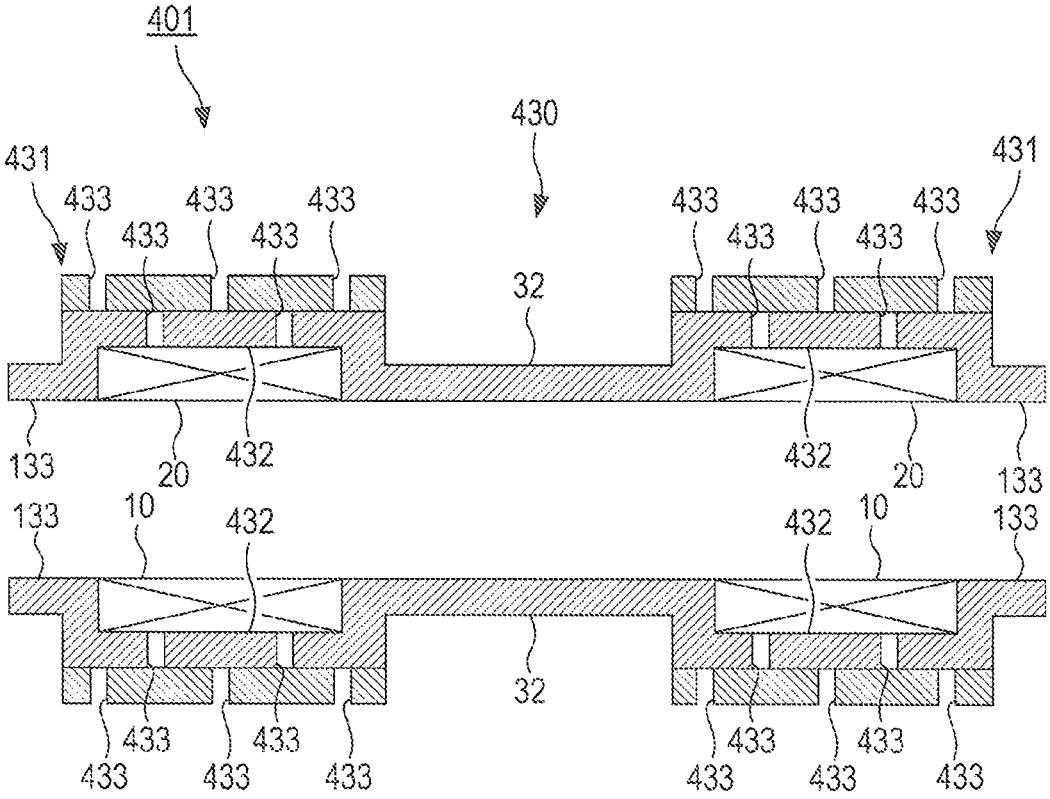
FIG. 23 is a view showing a modification of the present invention.

FIG. 23 shows a configuration of the transformer 401 in FIG. 14 in which another core 430 is also provided at the side of the primary coil 10.

What is claimed is:

1. A transformer comprising:

a primary coil and a secondary coil; and a rectangular core that is to be used in combination with the primary coil or the secondary coil, and wherein the core includes:

a conductor storage part which is a concave recess formed in an annular manner and in which a conductor of the primary coil or the secondary coil is to be arranged, wherein each of two opposing sides of the conductor storage part does not have an outer wall; and a central part which is located in a region inward from the conductor of the primary coil or the secondary coil when the core is used in combination with the primary coil or the secondary coil, and wherein the central part has a recessed shape having an opening that opens toward a direction opposite to a direction of an opening of the concave recess of the conductor storage part, wherein the central part has a generally flat end at a side opposite to a side of the opening of the central part so as to be contiguous with an inner opening edge of opening edges of the conductor storage part, and wherein the central part and the conductor storage part are formed as a monolithic piece.

2. The transformer according to claim 1, wherein a distance between the opening edges and an outer face of a closed end of the conductor storage part is larger than a thickness of the central part.

3. The transformer according to claim 1, wherein the central part includes an aperture that penetrates through the thickness of the central part.

4. The transformer according to claim 1, wherein the core is formed of a plurality of plate members stacked one upon another, and wherein each of the plurality of plate members includes one or more slits.

5. The transformer according to claim 4, wherein the plurality of plate members are stacked such that the one or more slits of any given one of the plurality of plate member does not overlap with the one or more slits of each of the plurality of plate members that is adjacent to the given one of the plurality of plate members.

6. The transformer according to claim 1, wherein the core is formed of a plurality of core segments that are separated from one another.

7. The transformer according to claim 1, wherein each of the primary coil and the secondary coil has at least two sides substantially parallel to each other, wherein the primary coil has a length longer than a length of the secondary coil in an extending direction of the two sides, wherein the core is to be used in combination with the secondary coil, wherein the core is formed of a plurality of core segments each extending in a direction substantially horizontally perpendicular to the two sides, and wherein the core segments are arranged to be spaced apart from one another in the extending direction of the two sides.

8. The transformer according to claim 1, wherein the core is to be used in combination with the secondary coil, and wherein the conductor storage part has a size such that only a predetermined portion of the secondary coil is arranged in the conductor storage part.

9. The transformer according to claim 8, wherein each of the primary coil and the secondary coil has at least two sides substantially parallel to each other, wherein the primary coil has a length longer than a length of the secondary coil in an extending direction of the two sides, wherein the conductor storage part has a length shorter than the length of the secondary coil in the extending direction of the two sides, and wherein a part of the secondary coil is exposed from the conductor storage part in areas at both ends of the conductor storage part in the extending direction of the two sides.

10. A transformer comprising:

a primary coil and a secondary coil; and a plurality of rectangular cores, and wherein the each of the cores includes:

a conductor storage part which is a concave recess formed in an annular manner and in which a conductor of the primary coil or the secondary coil is to be arranged, wherein each of two opposing sides of the conductor storage part does not have an outer wall; and a central part which is located in a region inward from the conductor of the primary coil or the secondary coil when the core is used in combination with the primary coil or the secondary coil, and wherein the central part has a recessed shape having an opening that opens toward a direction opposite to a direction of an opening of the concave recess of the conductor storage part, and wherein the central part has a generally flat end at a side opposite to a side of the opening of the central part so as to be contiguous with an inner opening edge of opening edges the conductor storage part, and wherein the plurality of cores are a first core that is to be used in combination with the primary coil and a second core that is to be used in combination with the secondary coil, and wherein the central part and the conductor storage part are formed as a monolithic piece.

11. The transformer according to claim 10, wherein a distance between the opening edges and an outer face of a closed end of the conductor storage part is larger than a thickness of the central part.

12. The transformer according to claim 10, wherein the central part includes an aperture that penetrates through the thickness of the central part.

13. The transformer according to claim 10, wherein each of the first core and the second core is formed of a plurality of plate members stacked one upon another; and wherein each of the plurality of plate members includes one or more slits.

14. The transformer according to claim 13, wherein the plurality of plate members are stacked such that the one or more slits of any given one of the plurality of plate members does not overlap with the one or more slits of each of the plurality of plate members that is adjacent to the given one of the plurality of plate members.

15. The transformer according to claim 10, wherein each of the first core and the second core is formed of a plurality of core segments that are separated from one another.

16. The transformer according to claim 10, wherein each of the primary coil and the secondary coil has at least two sides substantially parallel to each other, wherein the primary coil has a length longer than a length of the secondary coil in an extending direction of the two sides, wherein each of the first core and the second core is formed of a plurality of core segments each extending in a direction substantially horizontally perpendicular to the two sides, and wherein the core segments are arranged to be spaced apart from one another in the extending direction of the two sides.

17. The transformer according to claim 10, wherein the conductor storage part of the second core has a size such that only a predetermined portion of the secondary coil is arranged in the conductor storage part.

18. The transformer according to claim 17, wherein each of the primary coil and the secondary coil has at least two sides substantially parallel to each other, wherein the primary coil is formed to have a length longer than a length of the secondary coil in an extending direction of the two sides, wherein the conductor storage part has a length shorter than the length of the secondary coil in the extending direction of the two sides, and wherein a part of the secondary coil is exposed from the conductor storage part in areas at both ends of the conductor storage part in the extending direction of the two sides.

19. A transformer comprising:

a primary coil and a secondary coil; and a rectangular core that is to be used in combination with the primary coil or the secondary coil, and wherein the core includes:

a conductor storage part comprising a conductor storage part base, an inner annular conductor storage part wall, and first and second outer conductor storage part side walls respectively positioned on first and second opposing sides of the conductor storage part, wherein the inner annular conductor storage part wall and the first and second outer conductor storage part side walls are connected to the conductor storage part base, wherein the conductor storage part comprises a concave recess in which a conductor of the primary coil or the secondary coil is to be arranged, wherein each of third and fourth opposing sides of the conductor storage part does not have an outer side wall; and a central part which is located in a region inward from the conductor of the primary coil or the secondary coil when the core is used in combination with the primary coil or the secondary coil, and wherein the central part comprises a central part base, wherein the central part has a recessed shape having an opening that opens toward a direction opposite to a direction of an opening of the concave recess of the conductor storage part, and wherein the central part base is generally flat and contiguous with the inner annular conductor storage part wall, and wherein the central part and conductor storage part are formed as a monolithic piece.

20. A transformer comprising:

a primary coil and a secondary coil; and a plurality of rectangular cores, and wherein the each of the cores includes:

a conductor storage part comprising a conductor storage part base, an inner annular conductor storage part wall, and first and second outer conductor storage part side walls respectively positioned on first and second opposing sides of the conductor storage part, wherein the inner annular conductor storage part wall and the first and second outer conductor storage part sides walls are connected to the conductor storage part base, wherein the conductor storage part comprises a concave recess in which a conductor of the primary coil or the secondary coil is to be arranged, wherein each of third and fourth opposing sides of the conductor storage part does not have an outer side wall; and a central part which is located in a region inward from the conductor of the primary coil or the secondary coil when the core is used in combination with the primary coil or the secondary coil, and wherein the central part comprises a central part base, wherein the central part has a recessed shape having an opening that opens toward a direction opposite to a direction of an opening of the concave recess of the conductor storage part, and wherein the central part base is generally flat and contiguous with the inner annular conductor storage part wall, and wherein the plurality of cores are a first core that is to be used in combination with the primary coil and a second core that is to be used in combination with the secondary coil, and wherein the central part and the conductor storage part are formed as a monolithic piece.

* * * * *